US010582306B2

(12) United States Patent
Dehe

(10) Patent No.: US 10,582,306 B2
(45) Date of Patent: Mar. 3, 2020

(54) CAPACITIVE MEMS DEVICE, CAPACITIVE MEMS SOUND TRANSDUCER, METHOD FOR FORMING A CAPACITIVE MEMS DEVICE, AND METHOD FOR OPERATING A CAPACITIVE MEMS DEVICE

(71) Applicant: Infineon Technologies AG, Neubiberg (DE)

(72) Inventor: Alfons Dehe, Reutlingen (DE)

(73) Assignee: Infineon Technologies AG, Neubiberg (DE)

( * ) Notice: Subject to any disclaimer, the term of this patent is extended or adjusted under 35 U.S.C. 154(b) by 85 days.

(21) Appl. No.: 15/446,643

(22) Filed: Mar. 1, 2017

(65) Prior Publication Data

US 2018/0255402 A1 Sep. 6, 2018

(51) Int. Cl.

| | |
|---|---|
| ***H04R 19/04*** | (2006.01) |
| ***H04R 19/02*** | (2006.01) |
| ***H04R 19/00*** | (2006.01) |
| *H04R 7/04* | (2006.01) |

(52) U.S. Cl.

CPC ..... *H04R 19/04* (2013.01); *H04R 19/005* (2013.01); *H04R 19/02* (2013.01); *H04R 7/04* (2013.01); *H04R 2201/003* (2013.01); *H04R 2499/11* (2013.01)

(58) Field of Classification Search

CPC ..... H04R 19/04; H04R 19/005; H04R 19/02; H04R 7/04; H04R 2201/003; H04R 2499/11

See application file for complete search history.

(56) References Cited

U.S. PATENT DOCUMENTS

| | | | | |
|---|---|---|---|---|
| 2003/0046554 | A1 | 3/2003 | Leydier et al. | |
| 2010/0266145 | A1* | 10/2010 | Aimo Suvanto .... | H04R 19/005 381/111 |
| 2014/0145276 | A1 | 5/2014 | Rombach | |
| 2015/0001647 | A1* | 1/2015 | Dehe ..... | B81B 3/0021 257/416 |

FOREIGN PATENT DOCUMENTS

| | | | |
|---|---|---|---|
| CN | 101572850 | A | 11/2009 |
| CN | 102396245 | A | 3/2012 |
| CN | 104254046 | A | 12/2014 |
| WO | 2011101291 | A1 | 8/2011 |

OTHER PUBLICATIONS

Dehe, Alfons, "MEMS Device", U.S. Appl. No. 61/870,112, filed Aug. 26, 2013, 55 pages.

* cited by examiner

*Primary Examiner* — Joshua Kaufman
(74) *Attorney, Agent, or Firm* — Slater Matsil, LLP

(57) ABSTRACT

A capacitive MEMS device, a capacitive MEMS sound transducer, a method for forming a capacitive MEMS device and a method for operating a capacitive MEMS device are disclosed. In an embodiment the capacitive MEMS device includes a first electrode structure comprising a first conductive layer and a second electrode structure comprising a second conductive layer, wherein the second conductive layer at least partially opposes the first conductive layer, and wherein the second conductive layer includes a multiple segmentation which provides an electrical isolation between at least three portions of the second conductive layer.

36 Claims, 15 Drawing Sheets

Sinus-like segmentation lines to avoid holes in the electrode

FIG 5G

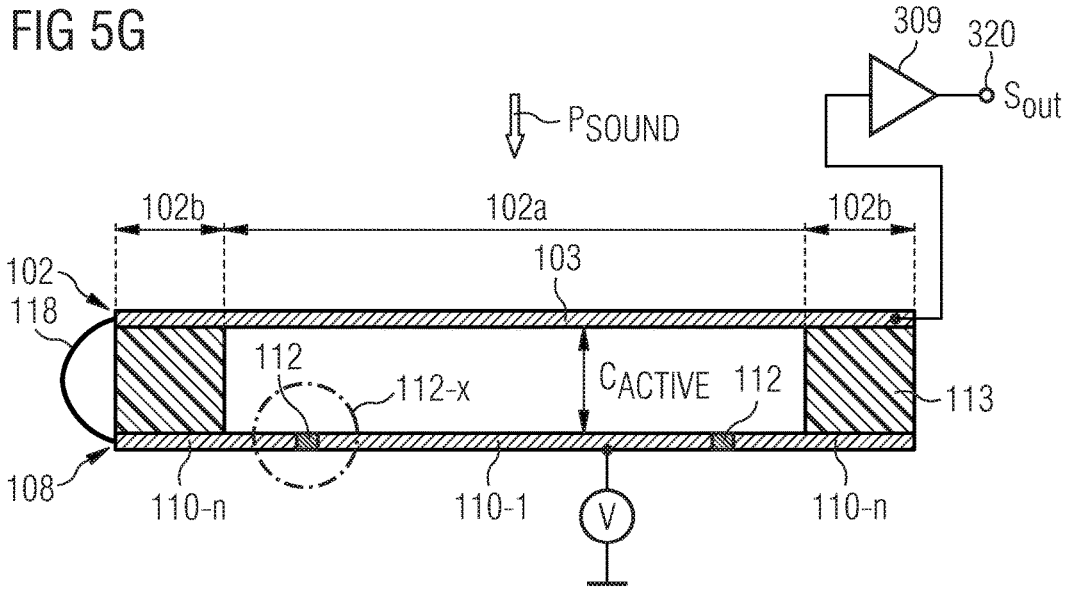

FIG 6

500 operating a capacitive MEMS device, wherein the capacitive MEMS device comprises a first electrode structure comprising a first conductive layer, and a second electrode structure comprising a second conductive layer, wherein the second conductive layer at least partially opposes the first conductive layer, wherein the second conductive layer comprises a multiple segmentation which provides an electrical isolation between at least three portions of the second conductive layer, comprising:

single-ended or differentially reading out the second electrode structure

510

CAPACITIVE MEMS DEVICE, CAPACITIVE MEMS SOUND TRANSDUCER, METHOD FOR FORMING A CAPACITIVE MEMS DEVICE, AND METHOD FOR OPERATING A CAPACITIVE MEMS DEVICE

TECHNICAL FIELD

The invention relates to a capacitive MEMS device (MEMS=microelectromechanical system), a capacitive MEMS sound transducer, a method for manufacturing a capacitive MEMS device, and a method for operating a capacitive MEMS device. Some embodiments relate to a MEMS microphone and/or MEMS speaker.

BACKGROUND

When designing capacitive MEMS devices, e.g. sound transducers, pressure sensors, acceleration sensors, microphones or loudspeakers, it may be typically desirable to achieve a high signal-to-noise ratio (SNR) of the transducer output signal. The continuous miniaturization of transducers may pose new challenges with respect to the desired high signal-to-noise ratio. MEMS microphones and to the same extent also MEMS loudspeakers which may be used in, for example, mobile phones, laptops, and similar (mobile or stationary) devices, may nowadays be implemented as semiconductor (silicon) micro-phones or microelectromechanical systems (MEMS). In order to be competitive and to provide the expected performance, silicon microphones may need a high SNR of the microphone output signal. However, taking the capacitor microphone as an example, the SNR may be typically limited by the capacitor microphone construction and by the resulting parasitic capacitances.

Parasitic capacitances are usually unwanted capacitances interfering with capacitances between the membrane and the counter electrode. Hence, capacitance values, which are intended to be transferred into electrical signals in response to the movement of the membrane relative to the counter-electrode, are interfered. In case the MEMS device is embodied as a MEMS microphone, for example, parasitic capacitances may influence the MEMS microphone such that the electrical output signal does not provide a sufficiently correct reproduction of the audible sound input signal, i.e. the arriving soundwaves or sound pressure changes.

SUMMARY

An embodiment provides a capacitive MEMS device comprising a first electrode structure comprising a first conductive layer, and a second electrode structure comprising a second conductive layer, wherein the second conductive layer at least partially opposes the first conductive layer, wherein the first conductive layer comprises a multiple segmentation which provides an electrical isolation between at least three portions of the first conductive layer.

A further embodiment provides a MEMS microphone comprising a capacitive MEMS device having a first electrode structure comprising a first conductive layer, and a second electrode structure comprising a second conductive layer, wherein the second conductive layer at least partially opposes the first conductive layer, wherein the first conductive layer comprises a multiple segmentation which provides an electrical isolation between at least three portions of the first conductive layer, wherein a displacement of the first conductive layer of the first electrode structure with respect to the second conductive layer of the second electrode structure is effected by an incident sound pressure change.

A further embodiment provides a method of forming a capacitive MEMS device, the method comprising: providing, in a stacked configuration, a first conductive layer, a second conductive layer and a support layer lying in between the first and second conductive layer, forming a plurality of gaps in the first conductive layer for providing an electrical isolation between at least three portions of the first conductive layer, depositing a dielectric layer onto the first conductive layer and into the gaps in the first conductive layer, and partially removing the support material between the first and second conductive layer so that a support structure remains in a peripheral area of the first and second conductive layer.

A further embodiment provides a method of operating a capacitive MEMS device, wherein the capacitive MEMS device comprises a first electrode structure comprising a first conductive layer, and a second electrode structure comprising a second conductive layer, wherein the second conductive layer at least partially opposes the first conductive layer, wherein the second conductive layer comprises a multiple segmentation which provides an electrical isolation between at least three portions of the second conductive layer, the method comprising the step of single-ended reading out the first or second electrode structure.

Thus, embodiments provide a concept for eliminating or at least reducing coupling capacitances (i.e. the multiple-segmentation capacitance $C_{mSEG}$) of multiple segmented portions of an electrode structure of a capacitive MEMS device and, further, the remaining parasitic capacitances of a capacitive MEMS device, e.g. of a capacitive MEMS sound transducer (MEMS microphone and/or MEMS speaker), wherein the capacitive MEMS device has a displaceable membrane or diaphragm as the movable structure, whose motion is to be capacitively detected with a (e.g. "static") counter electrode (backplate).

In accordance with embodiments, a multiple segmentation of the conductive layer of an electrode structure (e.g. the membrane and/or the counter electrode) is provided having the purpose to reduce the parasitic capacitance in order to improve the performance of the capacitive MEMS device. A multiple segmentation of the conductive layer of the electrode structure provides an electrical isolation (separation) between at least three portions of the respective conductive layer.

Based on the multiple segmentation of the conductive layer of the electrode structure, the so-called "transfer factor" of the MEMS device can be significantly increased. The transfer factor indicates the amount or portion of the variable active capacitance $C_{ACTIVE}$ in relation to the overall capacitance $C_{TOTAL}$ of the capacitive MEMS device. The overall capacitance $C_{TOTAL}$ comprises the active capacitance $C_{ACTIVE}$, the parasitic capacitance $C_{PAR}$ and the multiple-segmentation capacitance $C_{mSEG}$ of the capacitive MEMS device. To be more specific, the overall capacitance $C_{TOTAL}$ is the cumulative sum of the active capacitance $C_{ACTIVE}$ and the series connection of the parasitic capacitance $C_{PAR}$ and the multiple-segmentation capacitance $C_{mSEG}$.

Thus, an increased transfer factor, which indicates a decreased damping (attenuation) of the conversion of the incident sound pressure $P_{SOUND}$ into the output signal of the MEMS device, results in an increased output signal provided to the read-out circuit of the capacitive MEMS device and, thus, an accordingly increased signal-to-noise ratio of the capacitive MEMS device. In other words, given the variable active capacitance $C_{ACTIVE}$ and the parasitic capacitance $C_{PAR}$, a reduced segmentation capacitance $C_{mSEG}$ results in an increased transfer factor and, thus, in an increased SNR of the output signal of the capacitive MEMS device.

According to embodiments, the coupling capacitances of the segmented portions of an electrode structure of a capacitive MEMS device, e.g. a capacitive MEMS sound transducer, can be reduced by providing a multiple segmentation to a conductive layer of one of the opposing electrode structures, while maintaining high mechanical robustness of the resulting electrode structure(s) of the MEMS device.

According to an embodiment, the first electrode structure of the capacitive MEMS device comprises a first conductive layer, wherein the second electrode structure comprises a second conductive layer. The second conductive layer at least partially opposes (overlaps) the first conductive layer in a spaced apart configuration. The second conductive layer of the second electrode structure (e.g. the static electrode or the movable electrode) of the capacitive MEMS device is split into three portions, i.e. in an inner (first) portion and outer (second) portion and at least one (third) intermediate portion by means of a multiple-segmentation structure having a plurality of segmentation lines (e.g. in form of narrow gaps, grooves or slots) in the second conductive layer.

The outer (second) portion of the second conductive layer may be electrically connected to the first conductive layer of the first electrode structure (e.g. to the movable structure having a membrane or diaphragm).

In a further embodiment, the second electrode structure may comprise a further conductive layer. This further conductive layer may also be split into an inner portion, an outer portion and at least one intermediate portion by means of a further multiple segmentation (multiple segmentation lines). In case of an implementation with two conductive layers of the second electrode structure, the outer portions of both conductive layers of the second electrode structure may be electrically connected to the first conductive layer of the first electrode structure. As a result, a relative movement between the first electrode structure and the second electrode structure can be capacitively detected and read out.

As a variant, the multiple segmentation can additionally be applied to the first conductive layer of the first electrode structure. The first electrode structure may comprise the first conductive layer and a further conductive layer, in which case the multiple segmentation can also be applied to the further conductive layer of the first electrode structure.

Thus, the embodiments of providing a multiple segmentation to a conductive layer of the second and optionally first electrode structures is equally applicable to so-called dual-backplate configurations and/or dual-membrane configurations of the capacitive MEMS device.

BRIEF DESCRIPTION OF THE DRAWINGS

For a more complete understanding of the present invention, and the advantages thereof, reference is now made to the following descriptions taken in conjunction with the accompanying drawings, in which:

FIGS. 5*a*-5*g* show schematic cross-sectional views of different implementations of capacitive MEMS devices and schematic circuit diagram illustrating different readout configurations for the capacitive MEMS device and the resulting capacitances according to embodiments;

FIG. 6 shows an exemplary method of operating a capacitive MEMS device according to an embodiment.

Before discussing embodiments in further detail using the drawings, it is pointed out that in the figures and in the specification identical elements and elements having the same functionality and/or the same technical or physical effect, are usually provided with the same reference numbers or are identified with the same name, so that the description of these elements and of the functionality thereof as illustrated in the different embodiments are mutually exchangeable or may be applied to one another in the different embodiments.

DETAILED DESCRIPTION OF ILLUSTRATIVE EMBODIMENTS

In the following description, embodiments are discussed in detail, however, it should be appreciated that the embodiments provide many applicable concepts that can be embodied in a wide variety of specific semiconductor devices which can be capacitively read out, such as capacitive MEMS devices. The specific embodiments discussed are merely illustrative of specific ways to make and use the present concept and do not limit the scope. In the following description of embodiments, the same or similar elements having the same function have associated therewith the same reference signs or the same name, and a description for such elements will not be repeated for every embodiment. Moreover, features of the different embodiments as described herein may be combined with each other, unless specifically noted otherwise.

In the following, the present concept will be described with respect to embodiments in the context of capacitive MEMS devices in general, wherein the following description may also be applied to any MEMS sound transducer, such as (vacuum) microphones or loudspeakers having a single membrane or single backplate configuration or having a dual membrane or a dual backplate configuration, as well as to any capacitive pressure sensors, acceleration sensors, actuators, etc. which can be capacitively read out or can be capacitively activated.

Figure 1A:
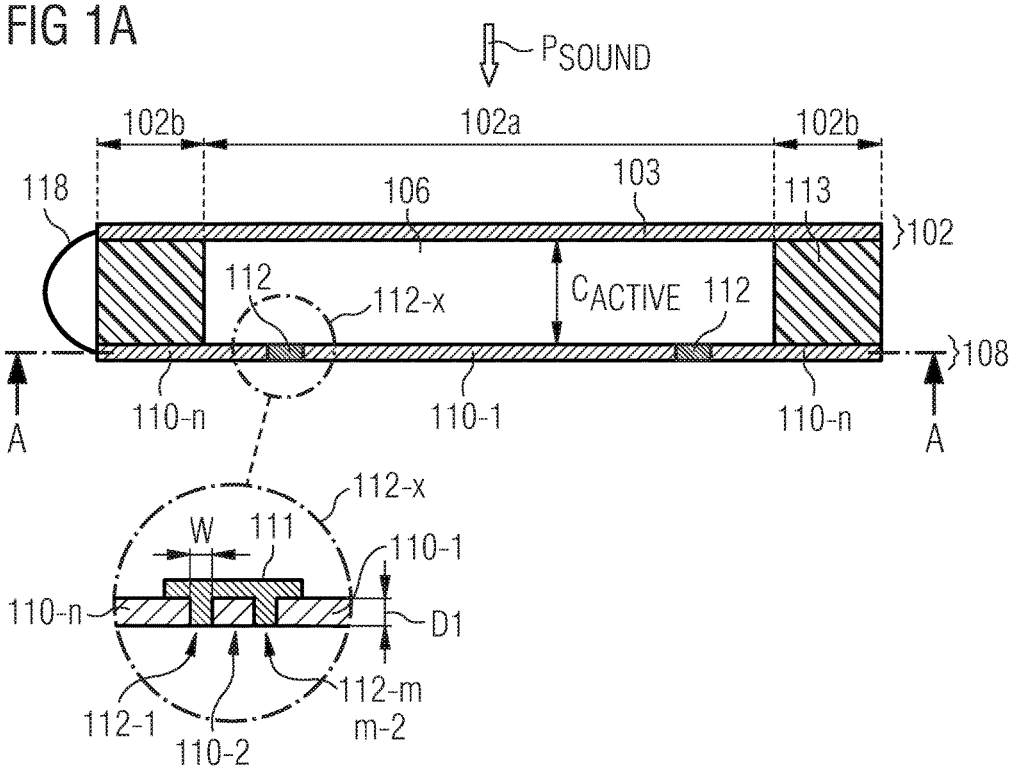
FIGS. 1*a*-1*b* show a schematic cross-sectional view and a schematic plane view of a capacitive MEMS device having a multiple segmented first electrode structure.
Figure 1B:
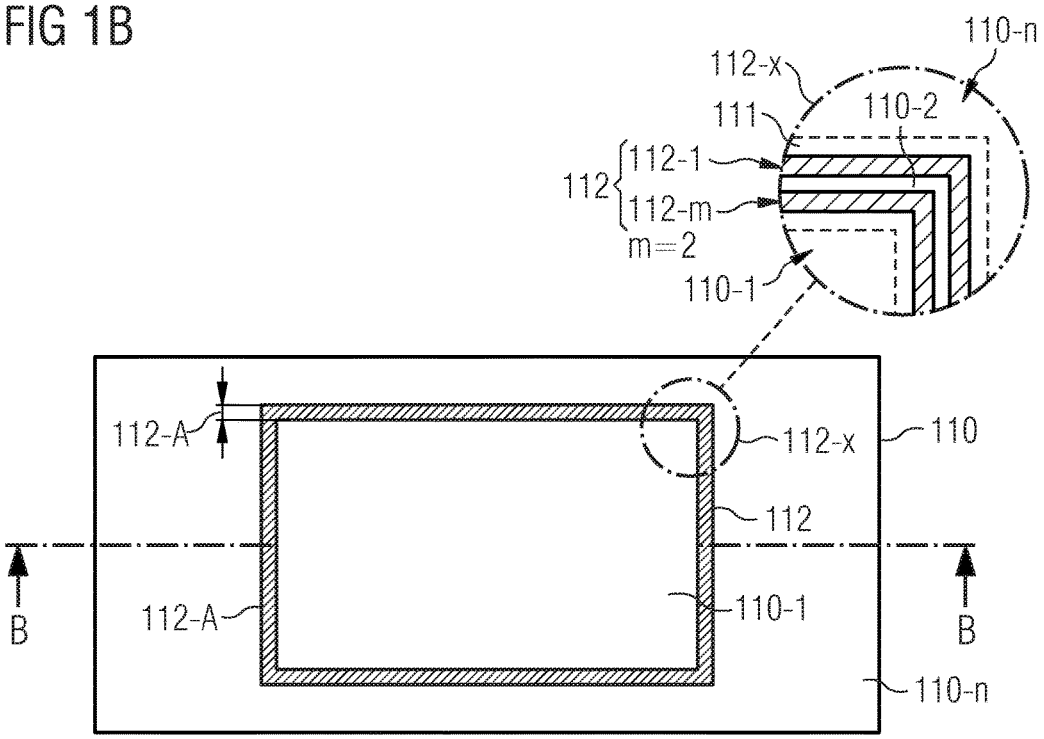

FIGS. 1*a*-1*b* show a schematic cross-sectional view and a schematic plane view of a capacitive MEMS device 100, e.g. a capacitive MEMS sound transducer, which comprises a multiple segmented electrode structure 108. FIG. 1*b* shows a plane view of the capacitive MEMS device 100 of FIG. 1*a* with respect to the plane as indicated by the dashed line "AA" in FIG. 1*a*. The dashed line "BB" in FIG. 1*b* indicates the intersection plane of the cross-sectional view of FIG. 1*a*.

FIGS. 1*a*-1*b* schematically illustrates a concept for the capacitive MEMS device 100. The capacitive MEMS device 100 comprises a first electrode structure 102 (e.g. a first membrane or diaphragm element), comprising a first conductive layer 103, and a second electrode structure 108 (e.g. a counter electrode or backplate element) comprising a second conductive layer 110, which is spaced apart from the first conductive layer 103 and at least partially opposes the first conductive layer 103.

According to a further embodiment, the first electrode structure 102 may form a counter electrode or backplate element, wherein the second electrode structure 108 may form a membrane or diaphragm element.

The second conductive layer 110 comprises a multiple segmentation (structure) 112 which provides an electrical isolation or separation between at least three portions 110-1, 110-2, 110-*n* of the second conductive layer 110.

As shown in the enlarged schematic detail view (in the dashed line 112-X) of the multiple segmentation 112 of the second conductive layer 110, the multiple segmentation 112 of the second conductive layer 110 comprises a plurality of gaps 112-1, 112-*m*, e.g. in the form of narrow gaps, grooves, slots, separation lines or segmentation lines, in the second conductive layer 110, wherein each of the gaps 112-1, 112-*m* provides an electrical isolation between two neighboring portions 110-1, 110-2, 110-*n*, respectively, of the second conductive layer 110. A non-conductive connecting (or bridging) structure 111 having an insulating material is provided for mechanically connecting the neighboring portions 110-1, 110-2, 110-*n* of the second conductive layer 110. As indicated in FIG. 1*a*, the multiple segmentation 112 comprises "m=2" gaps resulting in "n=3" electrically isolated portions 110-1, 110-2, 110-*n* of the second conductive layer 110. In general, the multiple segmentation 112 may comprises "m" gaps (with m=2, 3, 4, 5, . . . ) resulting in "n" electrically isolated portions of the second conductive layer 110, wherein "n=m+1" The non-conductive connecting structure 111 mechanically connects the neighboring portions 110-1, 110-2, 110-*n* of the second conductive layer 110.

As indicated in FIG. 1*a*, the first electrode structure 102 may comprise the first conductive layer 103, wherein the second electrode structure 108 may comprise the second conductive layer 110. However, the following explanations are equally applicable to an arrangement having electrode structures 102, 108 with (at least) two (e.g. electrically isolated) conductive layers, for example, i.e. providing for so-called dual backplate (counter electrode) and/or dual membrane configurations of a capacitive MEMS sound transducer.

As further shown in FIG. 1*a* a spacer or support element 113 may be arranged between the first and second electrode structure 102, 108 in a peripheral anchoring area, for holding the first and second conductive layers 103, 110 in a predefined distance from each other. As it is further shown in FIG. 1*a*, the first conductive layer 103 comprises a displaceable (movable) portion 102*a* and a fixed portion 102*b*, wherein the fixed portion 102*b* of the first conductive layer 103 is, for example, mechanically connected to the spacer element 113. Moreover, the second conductive layer 110 is, for example, also fixed to the spacer element 113. In the description, the terms deflectable, displaceable and movable are interchangeable terms. The same applies to the terms deflection and displacement, for example.

FIG. 1*b* shows an exemplary illustration in the form of a plane view of the capacitive MEMS device 100 of FIG. 1*a* with respect to the intersection plane as indicated by the dashed line "AA" in FIG. 1*a*. The dashed line "BB" in FIG. 1*b* indicates the intersection plane of the cross-sectional view of FIG. 1*a*. As illustrated in FIG. 1*b*, the second conductive layer 110 and the multiple segmentation 112 are illustrated, only by way of example, as having a square form. Alternatively, these elements may comprise also a circular circumferential form or any other geometrically suitable (polygonal) circumferential form or design.

As exemplarily shown in FIG. 1*b*, the multiple segmentation 112 in the second conductive layer 110 comprises a plurality ("m") of circumferential gaps or recesses, e.g. in form of narrow gaps, grooves, slots, segmentation lines, in the second conductive layer 110.

As shown in the enlarged schematic detail view (in the dashed line 112-X) of the multiple segmentation 112 of the second conductive layer 110, the multiple segmentation 112 of the second conductive layer 110 comprises "m=2" gaps 112-1, 112-*m* in the second conductive layer 110, the gaps 112-1, 112-*m* providing for an electrical isolation between n=3 neighboring portions 110-1, 110-2, 110-*n* of the second conductive layer 110. In general, the multiple segmentation 112 may comprise "m" gaps (with m=2, 3, 4, 5, . . . ) resulting in "n" electrically isolated portions of the second conductive layer 110, wherein "n=m+1". The non-conductive connecting structure 111 mechanically connects the neighboring portions 110-1, 110-2, 110-*n* of the second conductive layer 110.

As shown in FIGS. 1*a*-1*b*, the m gaps 112-1, 112-*m* of the multiple segmentation structure 112 may be arranged in a circumferential or border region in the second conductive layer 110. The gaps 112-*m* may be arranged in an equidistant configuration to each other in the second conductive layer 110. Thus, the gaps 112-1, 112-*m* in the second conductive layer 110 may be arranged in a segmentation area 112-A of the second conductive layer 110, wherein the segmentation area 112-A is formed in a circumferential, border region of the second conductive layer 110. The gaps 112-1, 112-*m* may have a width between 100 to 1000 nm or between 200 to 500 nm. The second conductive layer 110 may have in the segmentation area 112-A a thickness $D_1$, wherein the gaps may have a width W between $D_1/2$ and $2*D_1$, wherein W may be typically in the range of $D_1$.

The gaps 112-*m* may be partially or completely filled with the non-conductive material of the connecting structure 111. The non-conductive connecting structure may be formed as a layer having a thickness of between 100 to 1000 nm or between 200 to 500 nm.

As shown in FIGS. 1*a*-*b*, the multiple segmentation 112 provides an electrical isolation between a first portion 110-1, a second portion 110-*n* and a third (intermediate) portion 110-2 of the second conductive layer 110, wherein the first portion 110-1 is a center portion (active portion) of the second conductive layer 110, the second portion 110-*n* is a boundary portion (fringe portion) of the second conductive layer 110, and the third portion 110-2 is an intermediate portion of the first conductive layer between the first and second portions 110-1, 110-*n* of the second conductive layer 110. As shown in FIGS. 1*a*-1*b*, the second portion 110-*n* of the second conductive layer 110 is at least partially supported (anchored) by the mechanical support structure 113.

The first portion 110-1 of the second conductive layer 110 may form a displaceable or movable part of the second electrode structure 110.

As further shown in FIGS. 1*a*-1*b*, the multiple segmentation structure 112 may comprise a "double" segmentation with two gaps 112-1, 112-2 and with one intermediate portion 110-2 of the second conductive layer 110 between the first and second portions 110-1, 110-*n* of the second conductive layer 110.

Figure 2A:
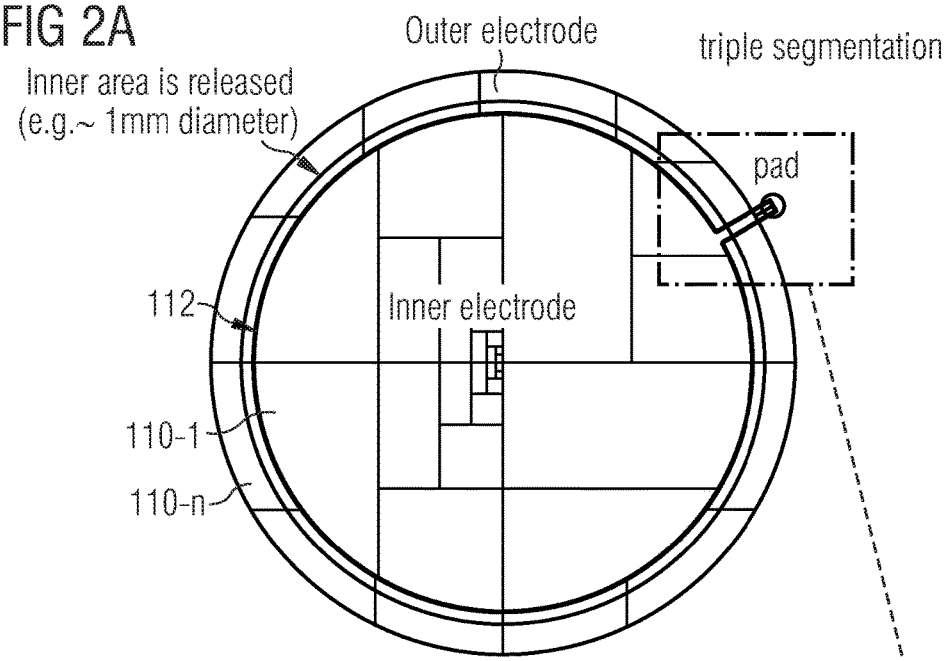
FIGS. 2*a*-2*c* show different schematic plane views with increasing magnification factors of the multiple segmented first electrode structure according to an embodiment.
Figure 2B:
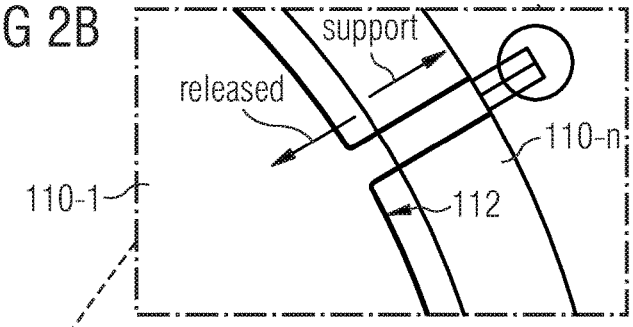
Figure 2C:
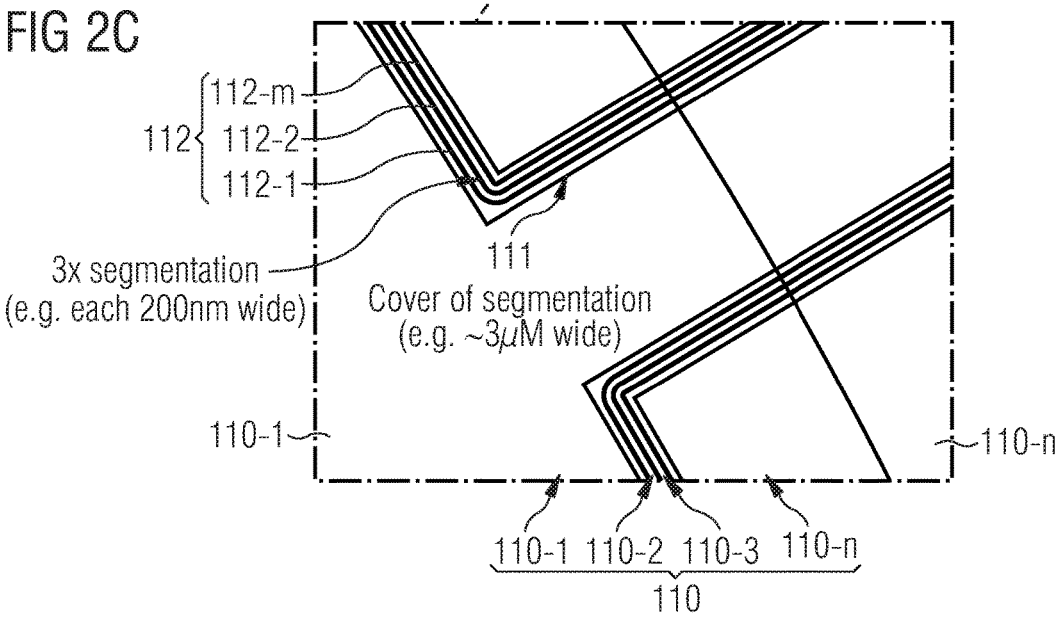
Figure 3A:
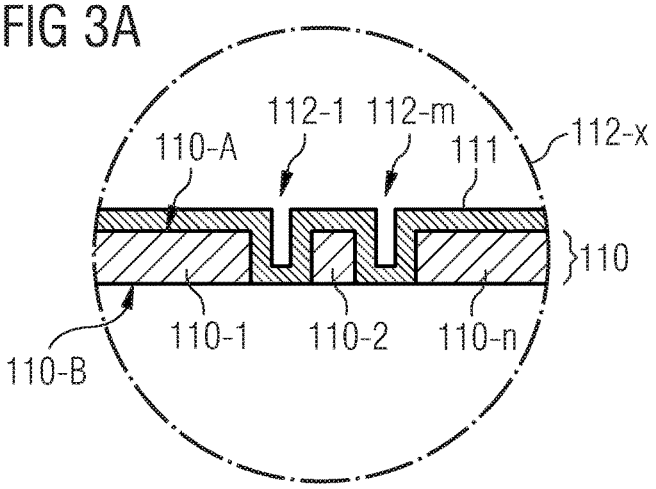
FIGS. 3*a*-3*f* show schematic partial cross-sectional views of the multiple segmentation areas of the first electrode structure according to embodiments.
Figure 3B:
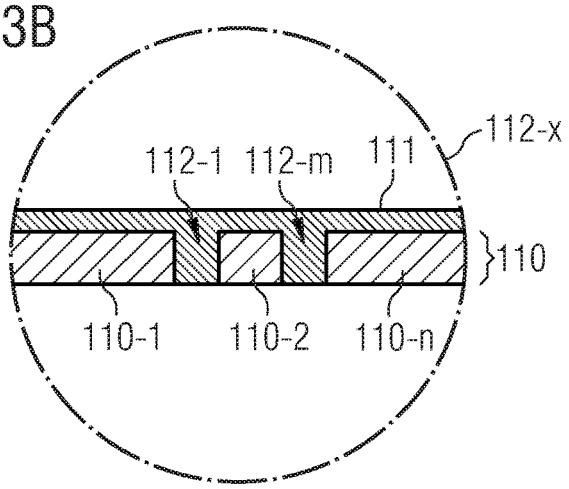
Figure 3C:
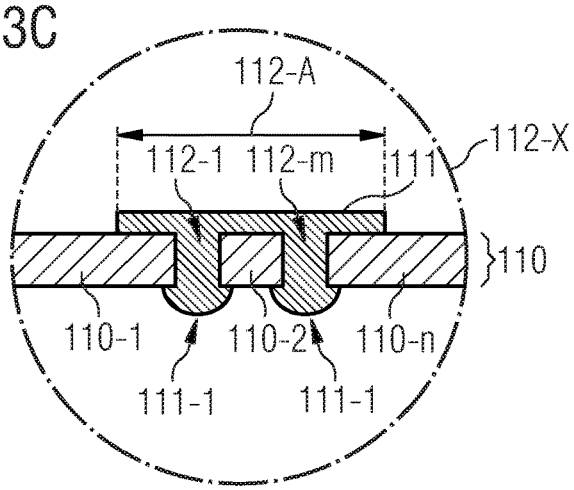
Figure 3D:
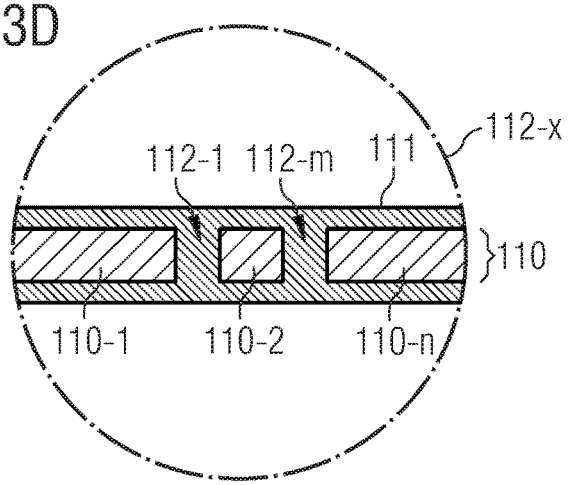
Figure 3E:
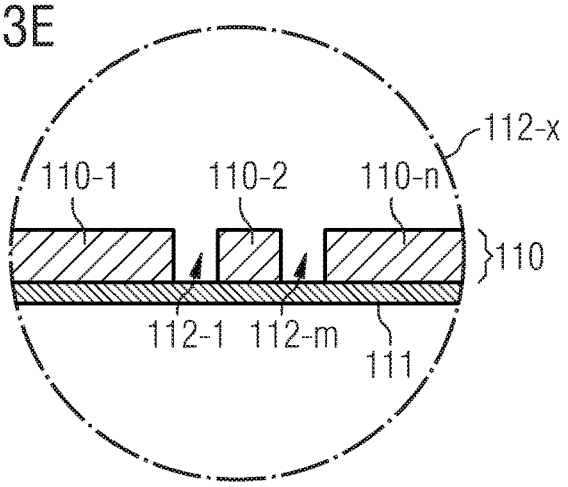
Figure 3F:
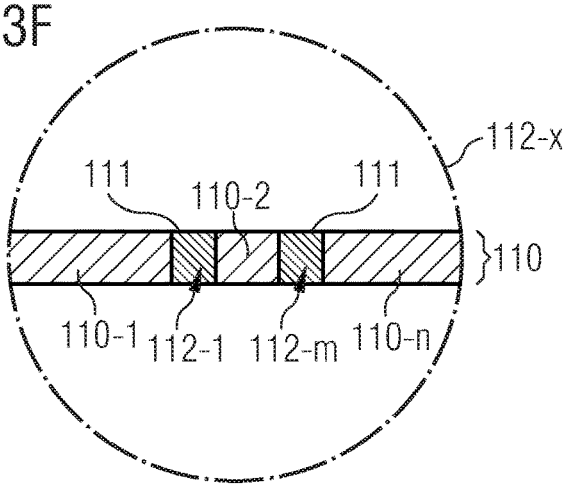

Alternatively the multiple segmentation structure 112 may comprise a triple segmentation of the second conductive layer 110 with two neighboring intermediate portions 110-2, 110-3 of the second conductive layer, wherein the triple segmentation has three gaps 112-1, 112-2, 112-*m*. In case of a triple segmentation (see also for example FIGS. 2*a*-2*c* and the associated specification passages), the triple segmentation provides an electrical isolation between four portions 110-1, 110-2, 110-3, 110-*n* of the second conductive layer 110, wherein the first portion 110-1 is a center portion of the second conductive layer 110, the second portion 110-*n* is the border portion of the second conductive layer 110, and wherein the third and fourth portions 110-2, 110-3 of the second conductive layer are neighboring intermediate portions of the second conductive layer between the first and second portions 110-1, 110-*n* of the second conductive layer 110.

The multi-segmentation may further comprise a quad segmentation with three neighboring intermediate portions 110-2, 110-3, 110-4 of the second conductive layer 110, wherein the quad segmentation has four gaps 112-1, 112-2, 112-3, 112-*m*. The quad segmentation provides an electrical isolation between five portions (a first to fifth portion) 110-1, 110-2, 110-3, 110-4, 110-*n* of the second conductive layer 110, wherein the first portion 110-1 is a center portion of the second conductive layer 110, the second portion 110-*n* is a boundary portion of the second conductive layer 110, and the third, fourth and fifth portions 110-2, 110-3, 110-4 of the second conductive layer 110 are neighboring intermediate portions of the second conductive layer 110 between the first and second portion 110-1, 110-*n* of the second conductive layer 110.

The present multi-segmentation principle is further applicable to a larger number m of segmentation lines. Generally speaking, the multiple segmentation 112 may comprise "m" gaps, with m=2, 3, 4, 5, 6, . . . , resulting in "n" electrically isolated portions of the second conductive layer 110, wherein "n=m+1".

As shown in FIGS. 1*a*-1*b*, a boundary portion 102*b* of the first electrode structure 102 may be supported by the support structure 113 and retained in the spaced apart position from the second electrode structure 108, so that a "sensing gap" 106 is formed between the first and second conductive layers 103, 110.

According to embodiments, the first conductive layer 103 of the first electrode structure 102 may form a movable (deflectable) membrane element, wherein the second conductive layer 110 of the second electrode structure 108 may form a counter electrode (back plate) with respect to the membrane (the first conductive layer) 103. Thus, a deflection of the first conductive layer 103 of the first electrode structure 102 with respect to the second conductive layer 110 of the second electrode structure 108 results in a change of capacitance $C_{ACTIVE}$ between the first and second electrode structures 102, 108. According to embodiments, the first conductive layer may additionally comprise a multiple segmentation (not shown in FIGS. 1*a*-1*b*) which provides an electrical isolation between at least three portions of the first conductive layer 103.

Alternatively, the second conductive layer 110 of the second electrode structure 108 may form a movable (deflectable) membrane element, wherein the first conductive layer 103 of the first electrode structure 102 may form a counter electrode (backplate) with respect to the membrane element (second conductive layer) 110. Thus, according to embodiments, at least the second and optionally also the first electrode structure(s) may comprise the multiple segmentation of the respective (first and/or second) conductive layer 103, 110.

Where the first electrode structure 102 comprises a multiple segmentation (not shown in FIGS. 1*a*-1*b*) in the first conductive layer 103, the multiple segmentation provides an electrical isolation between a first portion, a second portion and a third portion of the first conductive layer 103, wherein the first portion is a center portion of the first conductive layer 103, the second portion is a boundary portion of the first conductive layer 103, and the third portion is an intermediate portion of the first conductive layer 103 between the first and second portion of the first conductive layer 103. Thus, the plurality of ("m") gaps in the first conductive layer 103 may be arranged in a segmentation area 112-B of the first conductive layer 103. The plurality of gaps in the second conductive layer 110 may be arranged in the segmentation area 112-A of the second conductive layer 110. The segmentation areas 112-A, 112-B of the first and second conductive layers 103, 110 may be arranged, in a vertical projection with respect to the plane view of FIG. 1*b*, in an at least partially overlapping or coinciding configuration.

The capacitive MEMS device 100 may further comprise a third electrode structure (not shown in FIGS. 1*a*-1*b*) comprising a third conductive layer. The third conductive layer may comprise a further multiple segmentation which provides an electrical isolation between at least three portions of the third conductive layer (not shown in FIGS. 1*a*-1*b*). The third conductive layer may form in combination with the first conductive layer or with the second conductive layer a dual backplate or dual membrane configuration. A displacement of the second electrode structure may also result in a corresponding displacement of the third electrode structure, if the second and third electrode structures are mechanically coupled.

An intermediate region 106 may be implemented as a low pressure region, e.g. a vacuum region or near-vacuum region, which is located between the second and third electrode structures. Alternatively, (at least) the second and third electrode structures may be perforated, wherein the intermediate region 106 may have a (fluid) pressure (approximately) equal to the ambient pressure.

Thus, the first portion 110-1 of the second conductive layer 110 is a middle or center portion of the conductive layer 110, wherein the second portion 110-*n* of the conductive layer 110 is a fringe or edge portion (anchored in or supported on the support element 113) of the second conductive layer 110. Thus, the middle or central portion 110-1 may be regarded as the "electrically active" portion of the conductive layer 110 and forms the variable active capacitance $C_{ACTIVE}$ which contributes to the useful capacitance of the capacitive MEMS device. The variable active capacitance $C_{ACTIVE}$ is formed between the displaceable portion 110-1 of the second conductive layer and the first electrode structure 102 comprising the first conductive layer 103. Alternatively, where the first conductive layer 103 of the first electrode structure 102 forms a movable (deflectable) membrane element and the second conductive layer 110 of the second electrode structure 108 forms a counter electrode (backplate) with respect to the membrane element (first conductive layer), the variable active capacitance $C_{ACTIVE}$ is formed between the middle or central portion 110-1 of the second conductive layer and the movable (deflectable) portion 102*a* of the first conductive layer 103.

As optionally shown in FIG. 1*a*, the second portion 110-*n* of the second conductive layer 110 may be electrically coupled by means of a connection element 118 to the first conductive layer 103. As it is schematically shown in FIG. 1*a*, the first electrode structure 102 may be exposed to an ambient pressure (or pressure change) and potentially a sound pressure $P_{SOUND}$ or sound pressure change $\Delta P_{SOUND}$. This side of the capacitive MEMS device may also be regarded as a sound receiving main surface of the MEMS device 100, wherein an ambient pressure change may result in a displacement of the first electrode structure 102. As shown in FIGS. 1*a*-1*b*, the multiple segmentation (structure) 112 of the second electrode structure 108 provides for the multiple segmented second conductive layer 110, wherein the multiple segmentation 112 of the second conductive layer 110 is arranged to provide an electrical isolation between the at least three portions 110-1, 110-2, 110-*n* of the second conductive layer 110, i.e. to provide an electrical isolation between the first (active) portion 110-1 of the second conductive layer 110 and the further (substantially inactive) portions 110-2, 110-*n* of the second conductive layer 110. The variable active capacitance $C_{ACTIVE}$ is observed between the displaceable portion 102*a* of the first electrode structure 102 and the first (active) portion 110-1 of the second conductive layer 110. Hence, the active capacitance $C_{ACTIVE}$ may respond to sound pressure changes $\Delta P_{SOUND}$ caused by speech, music, noise, etc. in the environment of the capacitive MEMS device 100.

In case of the capacitive MEMS device 100 FIGS. 1*a*-1*b*, the first and second electrode structures 102, 108 may have a rectangular shape, wherein also the multiple segmentation structure 112 in the form of the plurality of circumferential narrow gaps/recesses, e.g. in form of a plurality of segmentation grooves, may also comprise a rectangular circumferential shape, for example. However, in another configuration, the first and second electrode structures 102, 108 may also have a circular shape, wherein also the segmentation structure may be formed circularly. Independent of the shape of the first and second electrode structures 102, 108 the multiple segmentation structure in form of the plurality of circumferential narrow gaps 112 may have any appropriate, e.g. circular, rectangular, nearly-closed polygonal circumferential shape. The (at least one) conductive layer 110 of the second electrode structure 108 may be made of or may comprise an electrically conductive material, for example, silicon, poly-silicon or any metallization.

By the provision of the multiple segmentation of the second conductive layer 110 of the second electrode structure 108, the coupling capacitance may be reduced greatly, since the separated and insulated (inactive) portions 110-2, . . . , 110-*n* of the second conductive layer 110 do not—or at most in a very reduced way—contribute to the creation of the parasitic capacitance $C_{PAR}$, wherein the second (inactive) portion 110-*n* of the second conductive layer 110 may be electrically connected to the first conductive layer 103.

Moreover, based on the multiple segmentation of the conductive layer of one of the opposing electrode structures 102, 108 into at least three portions the coupling capacitance of the segmentation structure 112 can be reduced (when compared to a segmentation having a single segmentation line). The multiple segmentation lines 112-1, . . . , 112-*m*, which are coupled in series, are effective to divide down the resulting coupling capacitance. The resulting coupling capacitance $C_{mSEG}$ of the multiple segmentation structure is reduced by the factor m when compared to a single segmentation line, wherein m is the number of the segmentation lines of the multiple segmentation structure 112.

Based on the multiple segmentation of the conductive layer 110 of the electrode structure, the so-called "transfer factor $f_{TF}$" of the MEMS device can be significantly increased as the parasitic capacitance $C_{PAR}$ and the coupling or segmentation capacitance $C_{mSEG}$ are reduced. The transfer factor indicates the amount or portion of the variable active capacitance $C_{ACTIVE}$ in relation to the overall capacitance $C_{TOTAL}$ of the capacitive MEMS device 100. The overall capacitance $C_{TOTAL}$ comprises the active capacitance $C_{ACTIVE}$, the parasitic capacitance $C_{PAR}$ and the multiple-segmentation capacitance $C_{mSEG}$ of the capacitive MEMS device 100. To be more specific, the overall capacitance $C_{TOTAL}$ is the cumulative sum of the active capacitance $C_{ACTIVE}$ and the series connection of the parasitic capacitance $C_{PAR}$ and the multiple-segmentation capacitance $C_{mSEG}$.

Figure 1C:
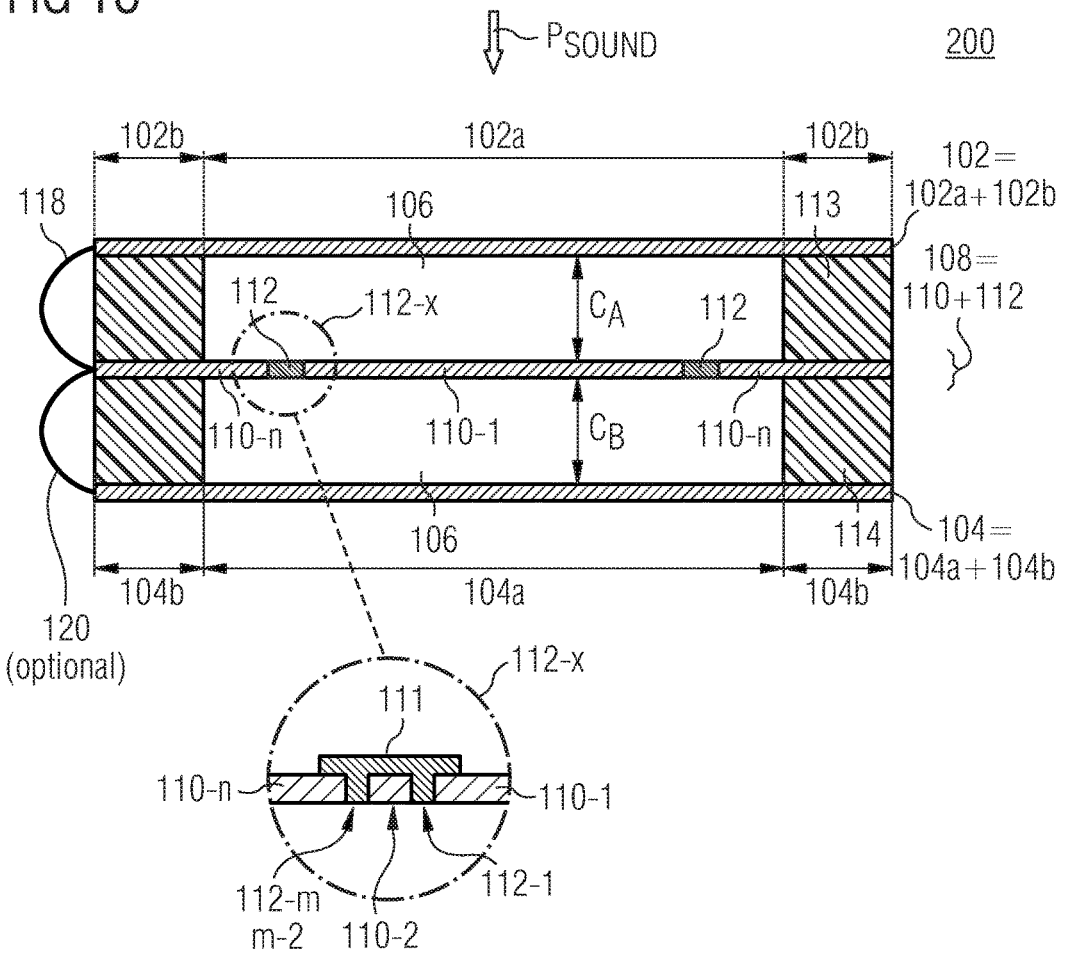
FIG. 1*c* shows a schematic cross-sectional view of a capacitive MEMS device having a multiple segmented first electrode structure (e.g. a multiple-segmented back plate) and a second and third electrode structure.

FIG. 1*c* shows a schematic cross-sectional view of a MEMS device 200, e.g. a capacitive MEMS sound transducer, comprising a first electrode structure 102 comprising a first membrane or diaphragm element, a second electrode structure 108 comprising a multiple-segmented counter electrode, and a third electrode structure 104 comprising a second membrane or diaphragm element, wherein the second membrane element 104 is spaced apart from the first membrane element 102 and wherein the counter electrode 108 is spaced between the first and second membrane elements 102, 104.

An intermediate region 106 may be implemented as a low pressure region, e.g. a vacuum region or near-vacuum region, which is located between the first membrane element 102 and the second membrane element 104, wherein the low pressure region 106 may have a (gas or fluid) pressure less than an ambient pressure. Alternatively, the electrode structures 102, 104 may be perforated wherein the intermediate region 106 may have a (gas or fluid) pressure (approximately) equal to the ambient pressure.

The second electrode structure 108 (i.e. a counter electrode structure or backplate structure 108) comprises (at least one) conductive layer 110, which is at least partially arranged in the intermediate region 106 or extends in the intermediate region 106. The conductive layer 110 comprises a multiple-segmentation 112 which provides an electrical isolation or separation between at least three portions 110-1, 110-2, 110-*n* of the second conductive layer 110. As shown in FIG. 1*c*, the multiple segmentation 112 provides an electrical isolation between a first portion 110-1, a second portion 110-*n* and a third (intermediate) portion 110-2 of the second conductive layer 110, wherein the first portion 110-1 is a center portion (active portion) of the second conductive layer 110, the second portion 110-*n* is a boundary portion (fringe portion) of the second conductive layer 110, and the third portion 110-2 is an intermediate portion of the first conductive layer between the first and second portions 110-1, 110-*n* of the second conductive layer 110.

For allowing a differential read out of the MEMS device 200, the outer portion 110-*n* may be electrically isolated from the portions 110-1, 110-2. Thus, the electrically isolated outer portion lion of the single conductive layer 110 may be electrically connected to one of the movable membrane elements 102, 104 to avoid a shorting of the two membrane elements 102, 104. By biasing the inner part 110-1 of the conductive layer 110, the two membrane elements 102, 104 can be differentially read out, for example.

As indicated above, the counter electrode structure 108 may comprise (at least) one conductive layer 110, wherein the following explanations are equally applicable to an arrangement having a counter electrode structure 108 with two (or more) electrically isolated/insulated conductive layers, for example.

As further shown in FIG. 1*c*, (optional) spacer elements 113, 114 may be arranged between the first membrane element 102 and the counter electrode structure 108 and between the second membrane element 104 and the counter electrode structure 108 for holding the first and second membrane elements 102, 104 in a predefined distance from the counter electrode structure 108.

As it is also shown in FIG. 1*c*, the first membrane element 102 comprises a displaceable (movable) portion 102*a* and a fixed portion 102*b*, wherein the second membrane element 104 comprises a displaceable or movable portion 104*a* and a fixed portion 104*b*. The fixed portion 102*b* of the first membrane element 102 is, for example, mechanically attached to the first spacer element 113, wherein the fixed portion 104*b* of the second membrane element 104 is mechanically attached to the second spacer 114. Moreover, the counter electrode structure 108 is, for example, fixed (in a sandwiched manner) between the first and second spacer elements 113, 114. Thus, the first (inner) portion 110-1 of the conductive layer 110 is arranged between the displaceable portion 102*a* of the first membrane element 102 and the displaceable portion 104*a* of the second membrane element 104.

As the first portion 110-1 of the conductive layer 110 is a middle or center portion of the conductive layer 110 and the second portion 110-*n* of the conductive layer 110 is a fringe or edge portion of the conductive layer 110, the middle or central portion 110-1 may be regarded as the "electrically active" portion of the conductive layer 110, which contributes to the useful capacitance $C_{ACTIVE}$ and, thus, to the useful signal component of the sensor output signal.

Thus, variable active capacitances CA and CB form in combination the useful capacitance $C_{ACTIVE}$. The variable active capacitance CA is formed between the displaceable portion 102*a* of the first membrane element 102 and the counter electrode structure 108 (i.e. the first portion 110*a* of the conductive layer 110), wherein the variable active capacitance CB is formed between the displaceable portion 104*a* of the second membrane element 104 and the counter electrode structure 108 (i.e. the first portion 110*a* of the conductive layer 110).

As optionally shown in FIG. 1*c*, the second portion 110-*n* of the conductive layer 110 may be electrically coupled by means of a first connection element 118 to the first membrane element 102, and by means of a second (optional) connection element 120 to the second membrane element 104. The first and second membrane elements 102, 104 may be mechanically coupled. Further, the first and second membrane elements 102, 104 may also be electrically coupled or may be electrically decoupled (insulated). Alternatively, the first and second membrane elements 102, 104 may be electrically decoupled (insulated) for a differential read-out thereof.

The (optional) mechanical coupling of the first or second membrane elements 102, 104 results in a configuration wherein a displacement of one of the first or second membrane elements 102, 104 also leads, due to the mechanical coupling, to a corresponding displacement of the other membrane element. Thus, the displacement of the first and second membrane elements 102, 104 takes place "in parallel".

Where the intermediate region 106 is implemented as a low pressure region, e.g. a vacuum region or near-vacuum region, the low pressure region 106 may be located within a sealed cavity, which is formed between the first and second membrane elements 102, 104. To be more specific, the sealed cavity may be confined by the first and second membrane elements 102, 104 and the first and second spacer elements 113, 114. The pressure in the lower pressure region 106 may be substantially vacuum or near to vacuum.

As is schematically shown, the first membrane element 102 (and/or the second membrane element 104) may be exposed to an ambient pressure and potentially a sound pressure $P_{SOUND}$. This side of the membrane element may also be regarded as a sound receiving main surface of the MEMS device 200. A displacement of the first membrane element 102 may also result in a corresponding displacement of the second membrane element 104, if mechanically coupled. The low pressure region 106 may have a pressure that may be typically less than an ambient pressure or a standard atmospheric pressure.

To be more specific, according to an embodiment, the pressure in the low pressure region may be substantially a vacuum or a near-vacuum. Alternatively, the pressure in the low pressure region may be less than about 50% (or 40%, 25%, 10% or 1%) of the ambient pressure or the standard atmospheric pressure. The standard atmospheric pressure may be typically 101.325 kPa or 1113.25 mbar. The pressure in the low pressure region may also be expressed as an absolute pressure, for example less than 50, 40, 30 or less than 10 kPa.

Alternatively, the electrode structures 102, 104 may be perforated wherein the intermediate region 106 may have a (fluid) pressure (approximately) equal to the ambient pressure.

A further embodiment provides a method of operating a capacitive MEMS device as shown below in FIG. 6, wherein the capacitive MEMS device comprises a first electrode structure comprising a first conductive layer, a second electrode structure comprising a second conductive layer, and a third electrode structure comprising a third conductive layer wherein the second conductive layer is positioned at least partially between the first and third conductive layers, wherein the second conductive layer comprises a multiple segmentation which provides an electrical isolation between at least three portions of the second conductive layer, the method comprising the step of single-ended or differentially reading out the second electrode structure.

The above explanations with respect to the shape of the multiple-segmentation line in the (at least one) conductive layer 110 is correspondingly applicable to the case when a multiple-segmentation is provided in at least one of the first and second membrane elements 102, 104 as it will be described below with respect to FIGS. 1*d*-1*e*.

Figure 1D:
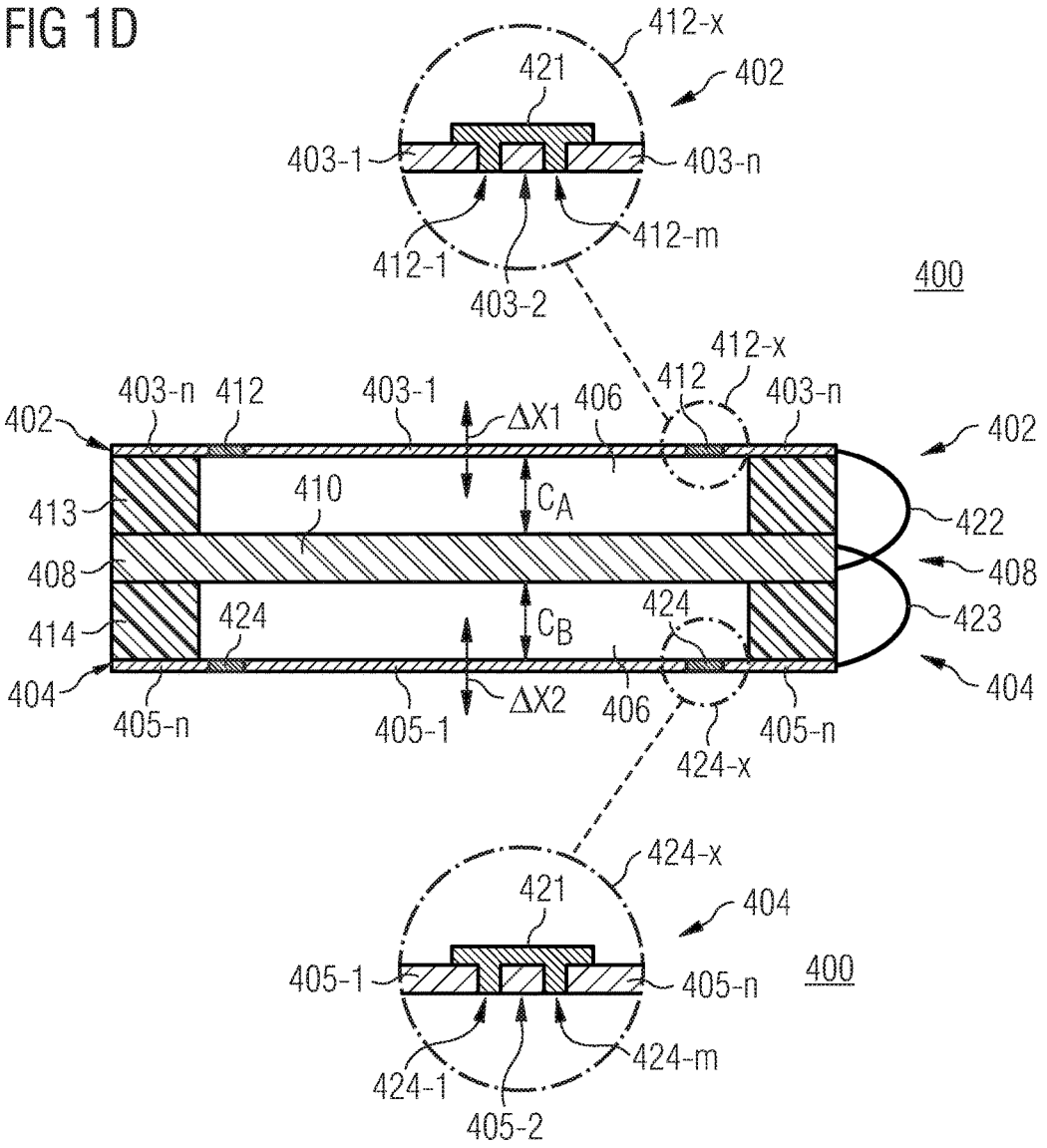
FIGS. 1*d*-1*e* show schematic cross-sectional views of a capacitive MEMS device comprising a multiple segmented second electrode structure (e.g. a multiple-segmented first membrane element) and a multiple segmented third electrode structure (e.g. a multiple-segmented second membrane element)
Figure 1E:
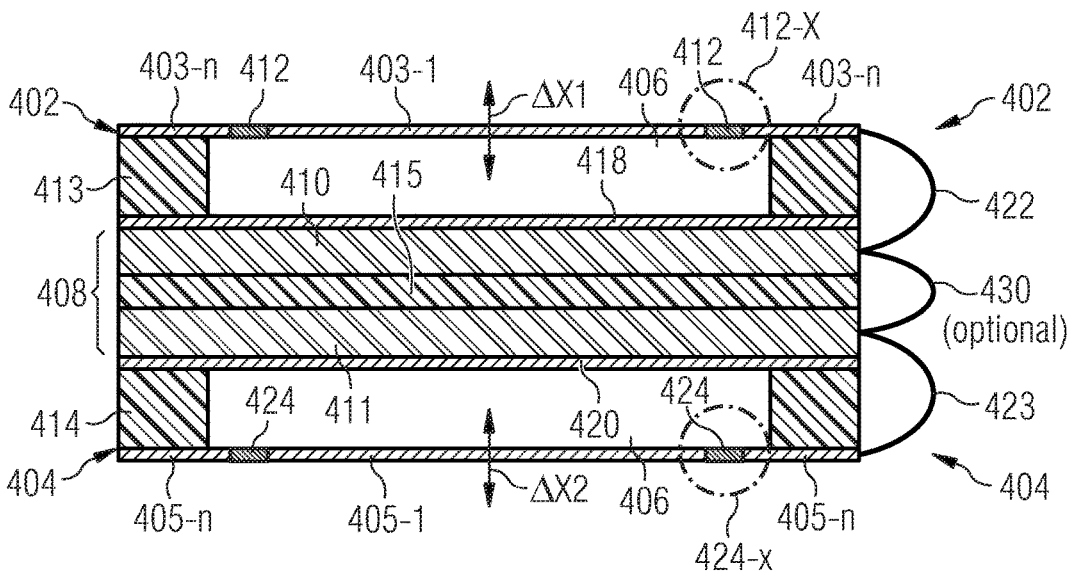

FIGS. 1*d*-1*e* show schematic cross-sectional views of further exemplary MEMS devices 400, e.g. a capacitive MEMS sound transducer (a vacuum MEMS microphone or vacuum MEMS loudspeaker) comprising a first multiple-segmented membrane element 402 and a second multiple-segmented membrane element 404, which is spaced apart from the first membrane element 402.

The capacitive MEMS device 400 comprises a first electrode structure 408 comprising a first conductive layer 410.

The capacitive MEMS device 400 further comprises a second electrode structure 402 comprising a second conductive layer 403, wherein the second conductive layer 403 at least partially opposes the first conductive layer 410, wherein the second conductive layer 403 comprises a multiple segmentation 412 which provides an electrical isolation between at least three portions of the second conductive layer. The multiple segmentation 412 provides an electrical isolation between at least a first portion 403-1, a second portion **403-*n* and a third portion 403-2 of the second conductive layer 403, wherein the first portion 403-1 is a center portion of the second conductive layer 403, the second portion 403-*n* is a boundary portion of the second conductive layer, and the third portion 403-2 is an intermediate portion of the second conductive layer 403 between the first and second portions 403-1, 403-*n*** of the second conductive layer.

The capacitive MEMS device 400 further comprises a third electrode structure 404 comprising a third conductive layer 405, wherein the third conductive layer 405 comprises a further multiple segmentation 424 which provides an electrical isolation between at least three portions of the second conductive layer 405. The further multiple segmentation 424 provides an electrical isolation between at least a first portion 405-1, a second portion **405-*n* and a third portion 405-2 of the third conductive layer 405, wherein the first portion 405-1 is a center portion of the third conductive layer 405, the second portion 405-*n* is a boundary portion of the third conductive layer 405, and the third portion 405-2 is an intermediate portion of the third conductive layer 405 between the first and second portions 405-1, 405-*n* of the third conductive layer 405**.

As shown in FIG. **1*d*, the first electrode structure 408 may form a counter electrode structure 408, the second electrode structure 402 may form a first multiple-segmented membrane element 402, and the third electrode structure 404 may form a second multiple-segmented membrane element 404 of the capacitive MEMS device 400**.

As shown in the enlarged schematic detail views (in the dashed lines 412-X, 424-X) of the multiple segmentations 412, 424 of the second and third conductive layers 403, 405, the multiple segmentations 412, 424 comprises "m=2" gaps 412-1, **412-*m* and 424-1, 424-*m* in the second and third conductive layer, respectively, the gaps providing for an electrical isolation between n=3 neighboring portions 403-1, 403-2, 403-*n* and 405-1, 405-2, 405-*n* of the second and third conductive layers 403, 405. In general, the multiple segmentations 412, 424 may comprises "m" gaps (with m=2, 3, 4, 5, . . . ) resulting in "n" electrically isolated portions of the second and third conductive layer 403 and 405, respectively, wherein "n=m+1". A non-conductive connecting structure 421 mechanically connects the neighboring portions 403-1, 403-2, 403-*n* and 405-1, 405-2, 405-*n* of the second and third conductive layers 403 and 405**, respectively.

An intermediate region 406 may be implemented as a low pressure region, which is located between the first and second membrane elements 402, 404, wherein the low pressure region 406 may have has a (gas or fluid) pressure less than an ambient pressure. Alternatively, the electrode structures 402, 404 may be perforated wherein the intermediate region 406 may have a (fluid) pressure (approximately) equal to the ambient pressure.

The counter electrode structure 408 comprises the first conductive layer 410 which is at least partially arranged in the intermediate region 406 or extends in the intermediate region 406. The first membrane element 402 comprises a multiple-segmentation 412 providing an electrical isolation between at least three portions 403-1, 403-2, **403-*n* of the first membrane element 402. The multiple-segmentation 412 of the first membrane element 402 may comprise the circumferential gaps 412-1, 412-*m* (e.g. in the form of narrow gaps, grooves, slots, separation lines or segmentation lines) in the first membrane element 402**.

The second membrane element 404 comprises the further multiple-segmentation 424 providing an electrical isolation between at least three portions 405-1, 405-2, **405-*n* of the second membrane element 404. The multiple-segmentation 424 of the second membrane element 404 may comprise the circumferential gaps 424-1, 424-*m* (e.g. in the form of narrow gaps, grooves, slots, separation lines or segmentation lines) in the second membrane element 404**.

The multiple-segmentation 412 of the first membrane element 402 and the multiple-segmentation 424 of the second membrane element 404 may be equally implemented and realized and may have the same structure as the multiple segmentation 112 of the second conductive layer 110 as described with respect to FIGS. **1*a-c* and 1*f***.

The first membrane element 402 may be at least partially covered with or embedded in an insulating material (not shown in FIG. **1*d*), wherein the second membrane element 404 may also be covered with or embedded in a further insulating material (not shown in FIG. 1*d*). The first conductive layer 410 of the counter electrode structure 408 may likewise be at least partially covered with or embedded in an insulating material (not shown in FIG. 1*d*). The second portion 403-*n* of the first membrane element 402 and the second portion 405-*n* of the second membrane element 404 may be electrically connected by a first and second connection 422, 423 with the first conductive layer 410**.

Thus, the connection elements 422, 423 provide electrical connections between the first conductive layer 410 of the counter electrode structure 408 and the outer parts **403-*n*, 405-*n* of the segmented membranes 402, 404. As shown in FIG. 1*d*, the counter electrode structure 408 (backplate) can be a uniform conductive layer 410**.

The MEMS device 400 may further comprise one or more pillars (not shown in FIGS. **1*d*-1*e*) for mechanically coupling the first membrane element and the second membrane element 402, 404. In case of a counter electrode structure 408 having a single conductive layer 410, the pillars (not shown in FIG. 1*d*) ensure a mechanical coupling but not an electrical connection between the two membrane elements 402, 404**. Thus, the pillars can be made at least partially of an insulating material.

Moreover, a first spacer element 413 is arranged between the first membrane element 402 and the counter electrode structure 408, wherein a second spacer element 414 is arranged is between the second membrane element 404 and the counter electrode structure 408. Furthermore, the multiple segmentation 412 in the first membrane element 402 may be located laterally outside of the first spacer element 413, wherein the second multiple segmentation 424 in the second membrane element 404 may also be located laterally outside of the second spacer element 414.

As shown in FIG. **1*e*, the counter electrode structure 408 may further comprise a fourth conductive layer 411, wherein the fourth conductive layer 411 is electrically isolated from the first conductive layer 410 by means of an insulating layer 415. The surface of the first conductive layer 410 opposite the insulating layer 415 may also be at least partially covered by an insulating material 418. Likewise, the surface of the fourth conductive layer 411 opposite the insulating layer 415 may also be at least partially covered by a further insulating material 420. The second portion 403**-*n* of the first membrane element 402 is electrically coupled, e.g. by means of an electrical connection or wiring 422, with the first conductive layer 410, wherein the second portion 405-*n* of the second membrane element 404 is electrically connected, e.g. by means of an electrical connection element or wiring, 423 to the fourth conductive layer 411. Moreover, an optional electrical connection 430 may be provided between the first and fourth conductive layers 410, 411.

The pillars made at least partially of an insulating material (not shown in FIG. 1*e*) may ensure a mechanical coupling but not an electrical connection between the two membrane elements 402, 404.

Alternatively, one or more of the pillars (not shown in FIG. 1*e*) which provide a mechanical coupling between the first and second membrane elements 402, 404 may also be electrically conductive for providing also an electric connection between the first and second membrane elements 402, 404, and especially between the first portions 402*a*, 404*a* of the first and second membrane elements 402, 404.

With respect to the MEMS microphone as shown in FIGS. 1*d*-1*e*, it should be noted that the different read out configurations for the MEMS device 100 as shown below are correspondingly applicable to the MEMS device 400.

With the exception of the specific segmentation of the counter electrode structure 108 of the MEMS device 100 or 200 (as shown in FIGS. 1*a*-1*c*) and of the membrane elements 402, 404 of the MEMS device 400 (as shown in FIGS. 1*d*-1*e*), the characteristics, dimensions and materials of the elements of the MEMS device 400 (of FIGS. 1*d*-1*e*) are comparable to the characteristics, dimensions and materials of the elements of MEMS device 100, 200. To be more specific, in the figures and the specification identical elements and elements having the same functionality and/or the same technical or physical effect are usually provided with the same reference numbers and/or with the same name, so that the description of these elements and of the functionality thereof as illustrated in the different embodiments are mutually exchangeable or may be applied to one another in the different embodiments.

Moreover, essentially the same or (at least) comparable read out configurations applied to the MEMS device 100 as shown in FIGS. 1*a*-1*b*, can be applied to the MEMS device 200 as shown in FIG. 1*c* and to the MEMS device 400 as shown in FIGS. 1*d*-1*e*. For example, comparing the various read out configurations of FIGS. 5*a*-5*g*, possible readout configurations of the MEMS device 400 in FIGS. 1*d*-1*e* may (only) comprise an inversion (or exchange) between the membranes and counter electrode with respect to the respective connections thereof to the reference potential(s) V (V1, V2) and the read out circuit, for example.

For instance, for MEMS device 400 in FIG. 1*d*, the conductive layer 410 can be polarized, i.e. provided with a reference potential V, wherein the first and second membrane elements 402, 404 (not electrically connected) can be differentially read out. Alternatively, the first and second membrane elements 402, 404 can be polarized, i.e. provided with a reference potential V, wherein the conductive layer 410 can be single ended read out.

For operating the MEMS device 400 in FIG. 1*e*, the first and second membrane elements 402, 404 can be polarized, i.e. provided with a reference potential V, and can be electrically connected, wherein the first and fourth conductive layers 410, 411 (not electrically connected) can be differentially read out. Alternatively, for MEMS device 400 in FIG. 1*e*, the first and fourth conductive layers 410, 411 (not electrically connected) of the counter electrode structure 408 can be polarized differently, i.e. provided with different reference potentials V1, V2, wherein the first and second membrane elements 402, 404 (which can be electrically connected) can be single ended or differentially read out.

Figure 1F:
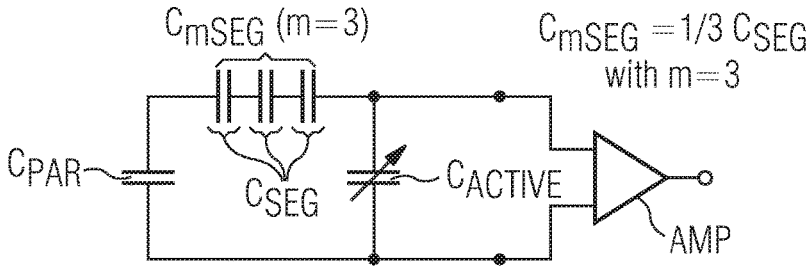
FIG. 1*f* shows a schematic circuit diagram illustrating a readout configuration for the capacitive MEMS device and the resulting capacitances.

In this connection, it is referred to FIG. 1*f* showing a schematic circuit diagram with the different capacitance portions $C_{ACTIVE}$, $C_{PAR}$, $C_{mSEG}$ of a capacitive MEMS device 100 in a typical readout configuration for the capacitive MEMS device 100. As shown in FIG. 1*f*, the multiple segmentation 112 of the second conductive layer 110 comprises "m=3" gaps 112-1, 112-*m* in the second conductive layer 110, the gaps 112-1, 112-*m* providing for an electrical isolation between n=4 neighboring portions of the second conductive layer 110. As shown in FIG. 1*f*, parallel to the variable active capacitance $C_{ACTIVE}$ of the capacitive MEMS device 100, a series connection of the parasitic capacitance $C_{PAR}$ and the coupling capacitance $C_{mSEG}$ is arranged, wherein the resulting capacitance $C_{TOTAL}$ can be read out for example, in a differential readout configuration.

As shown in FIG. 1*f*, the multiple-segmentation capacitance $C_{mSEG}$ is a serial connection of m=3 coupling capacitances $C_{SEG}$ resulting in: $C_{mSEG}=1/m\ C_{SEG}$.

The following equation indicates the so-called transfer factor indicating the amount or proportion of the variable active capacitance $C_{ACTIVE}$ in relation to the overall capacitance $C_{TOTAL}$ of the capacitive MEMS device 100 when considering further the parasitic capacitance $C_{PAR}$ and the multiple-segmentation capacitance $C_{mSEG}$ of the capacitive MEMS device 100.

$$\text{transfer_factor} = f_{TF} = \frac{C_{ACTIVE}}{C_{TOTAL}} = \frac{C_{ACTIVE}}{C_{ACTIVE} + \left(\frac{C_{PAR} * C_{mSEG}}{C_{PAR} + C_{mSEG}}\right)}$$

The above formula indicates that a decrease of at least one of the parasitic capacitance $C_{PAR}$ and the coupling capacitance $C_{mSEG}$ results in an increased transfer factor $f_{TF}$ and, further, in an decreased damping (attenuation) of the readout output signal of the MEMS device provided to the amplifier AMP.

In the following, an exemplary configuration is given based on exemplary capacitance values for the capacitive MEMS device 100, e.g. in form of a capacitive MEMS microphone:

$C_{ACTIVE}$=2 pF
$C_{PAR}$=2 pF
$C_{SEG}$ (m=1)=0.7 pF
$C_{mSEG}$ (m=3)=0.23 pF
Segmentation line 112-1, . . . 112-*m*: (4 mm long line, 0.2 μm wide, 0.5 μm high, filled with Si3N4)
Single segmentation (m=1): transfer_factor ~80%
Triple segmentation (m=3): transfer_factor ~91%
Thus, 14% win in signal is equivalent to ~1 dB signal and potential Signal to Noise Ratio.

For an exemplary capacitive MEMS device 100 it is assumed a (variable) active capacitance $C_{ACTIVE}$ with 2 pF, a parasitic capacitance $C_{PAR}$ also with 2 pF, and a coupling capacitance $C_{SEG}$ (with a single segmentation, m=1) with 0.7 pF and (with a triple segmentation, m=3) with 0.23 pF based on the following geometrical values of one segmentation line (4 mm long line, 0.2 μm wide, 0.5 μm high, filled with Si3N4).

As a result the above transfer factor is increased from $f_{TF}$=0.8 (80%) in case of a single segmentation line (m=1)

up to a transfer factor $f_{TF}$ of about 0.91 (91%) with a triple segmentation structure (m=3), i.e. a serial connection of three (m=3) couplings capacitances $C_{SEG}$. Thus, the resulting read-out signal provided to the readout circuit may be increased by about 14%, which is equivalent to a about 1 dB higher signal and an accordingly increased signal-to-noise ratio.

According to embodiments, the multiple segmentation structure 112 which provides an electrical isolation between at least three portions 110-1, 110-2, **110-*n* of the second conductive layer 110 allows a reduced width of the narrow gaps 112-1, . . . , 112-*m*. Thus, the multiple segmentation lines 112-1, . . . , 112-*m***, which space the different neighboring portions of the second conductive layer apart from each other may be effectively realized with a reduced width (<1 μm) and/or with a relatively high dielectric constant of an oxide or nitride material, when compared to the geometrical requirements of a single segmentation line for a (single) segmentation structure.

Based on the multiple segmentation structure 112 it is possible to provide for mechanical connections having a dielectric layer, e.g. with an oxide or silicon nitride material, for bridging the neighboring portions of the second conductive layer 110. This implementation is applicable, for example, to dual backplate sound transducers/microphones. Based on the multiple segmentation structure 112, it is possible to provide relatively narrow gaps in the conductive layer of the electrode structure which can be closed by the dielectric layer. Based on the multiple segmentation structure 112, the narrow gaps may be chosen not wider than two times the thickness of the second conductive layer 112. Thus, it is possible to close the narrow gaps, for example by means of a so-called "conformal deposition" (in vacuum) without forming any kind of (remaining) groove, so that any mechanical weakness of the resulting electrode structure 108 can be avoided.

Moreover, based on the multiple segmentation structure 112, the remaining coupling capacitance of the multiple segmentation lines, which may be typically several micrometers long—at the border of the second conductive layer 110, can be maintained relatively low and can support keeping the resulting parasitic capacitance of the capacitive MEMS device relatively low.

FIGS. **2*a*-2*c* now provide different schematic plane views (with increasing magnification factors) of an area of the second conductive layer 110 comprising the multiple segmentation structure 112 as illustrated in FIGS. 1*a*-1*c*. The multiple segmentation structure 112 may comprise a triple segmentation (with m=3) of the second conductive layer 110 with two neighboring intermediate portions 110-2, 110-3 of the second conductive layer, wherein the triple segmentation has three gaps 112-1, 112-2, 112-*m*. In case of a triple segmentation, the triple segmentation provides an electrical isolation between four portions 110-1, 110-2, 110-3, 110-*n* of the second conductive layer 110, wherein the first portion 110-1 is a center portion of the second conductive layer 110, the second portion 110-*n* is the border portion of the second conductive layer 110, and wherein the third and fourth portions 110-2, 110-3 of the second conductive layer are neighboring intermediate portions of the second conductive layer between the first and second portions 110-1, 110-*n* of the second conductive layer 110**.

FIGS. **3*a*-3*f* now provide, in an exemplary form, several enlarged illustrations of the multiple segmentation 112 as indicated by the dashed line 112-X in FIGS. 1*a*-1*f*. In FIGS. 3*a*-3*f*, it is indicated that the multiple segmentation structure 112 comprises two (m=2) narrow gaps which provide an electrical isolation between at least three portions of the second conductive layer. However, it should become clear that the following explanations are equally applicable to a multiple segmentation 112** which comprises m gaps (segmentation lines) resulting in n segmented portions (with n=m+1) of the second conductive layer.

FIG. **3*a* shows a configuration wherein the conductive layer 110 is covered (at least in the area adjacent to the multiple segmentations 112-1, 112-*m*) by an isolation layer 111, wherein the gaps 112-1, 112-*m* in the conductive layer 110 are at least partially filled with the material of the insulation layer 111 so that an electrically isolating mechanical connection between the first portion 110-1 and the second portion 110-*n* of the conductive layer 110** is provided. Thus, it is possible to close the narrow gaps, for example by means of a so-called "conformal deposition" (in vacuum).

FIG. **3*b* shows a configuration of the multiple-segmentation 112, wherein the gaps 112-1, 112-*m* between the first and second portions 110-1, 110-2 of the conductive layer 110 is completely filled with the material of the isolation layer 111, and wherein the conductive layer 110 is (at least in the area 112-A adjacent to the segmentation 112) covered by the material of the isolation layer 111**.

FIG. **3*c* shows a configuration of the multiple-segmentation 112, wherein the gaps 112-1, 112-*m* between the first and second portions 110-1, 110-2 of the conductive layer 110 is completely filled with the material of the isolation layer 111, wherein a first main surface 110A of the conductive layer 110 is (at least in the area 112-A adjacent to the segmentation 112) covered by the material of the isolation layer 111, and the material of the isolation layer 111 extends (into noses 111-1) to a second main surface 110B of the conductive layer 110. Here, the isolation layer 111 has (in the cross-sectional view of FIG. 3*c***) a "rivet" shape.

FIG. **3*d* shows a configuration of the multiple-segmentation 112, wherein the gaps 112-1, 112-*m* between the first and second portions 110-1, 110-*n* of the conductive layer 110 are completely filled with the material of the isolation layer 111, and wherein the conductive layer 110 is (at least in the area 112-A adjacent to the segmentation 112) completely embedded within the material of the isolation layer 111**.

FIG. **3*e* shows a configuration wherein the isolation layer 111 covers (at least in the area 112-A adjacent to the segmentation 112) the second surface 110B of the conductive layer 110, i.e. the first and second portions 110-1, 110-*n*, wherein the gaps 112-1, 112-*m* between the first and second portions 110-1, 110-*n* of the conductive layer 110 are free of any isolating material (i.e. does not comprise any isolating material) of the isolation layer 111**.

FIG. **3*f* shows a configuration, wherein (only) the gaps 112-1, 112-*m* between the first and second portions 110-1, 110-*n* of the conductive layer 110 are filled with an insulating material forming the segmentation 112 providing the electrically isolating mechanical connection between the first and second portions 110-1, 110-*n* of the conductive layer 110**.

As shown in FIGS. **3*a*-3*f*, the isolation layer 111 (isolation support layer 111) may be disposed (at least in the area 112-A, 112-B adjacent to the segmentation 112) on the conductive layer 110. The isolation layer 111 may be disposed over the entire area of the conductive layer 110 or only over a portion or different sections of the conductive layer 110. The isolation layer 111 may be disposed on the first or second surface area 110A, 110B of the conductive layer 110. The isolation layer 111** may comprise silicon dioxide, silicon nitride, a high-k dielectric such as silicon oxynitride, a polyamide or a combination thereof.

For sake of clarity, the preceding discussion of FIGS. 3*a*-3*f* concerning the multiple segmentation of the conductive layer 110 as shown in FIGS. 1*a*-1*c*, is equally applicable to multiple segmentation of the conductive layers 403, 405 as shown in FIGS. 1*d*-1*e*.

Figure 4A:
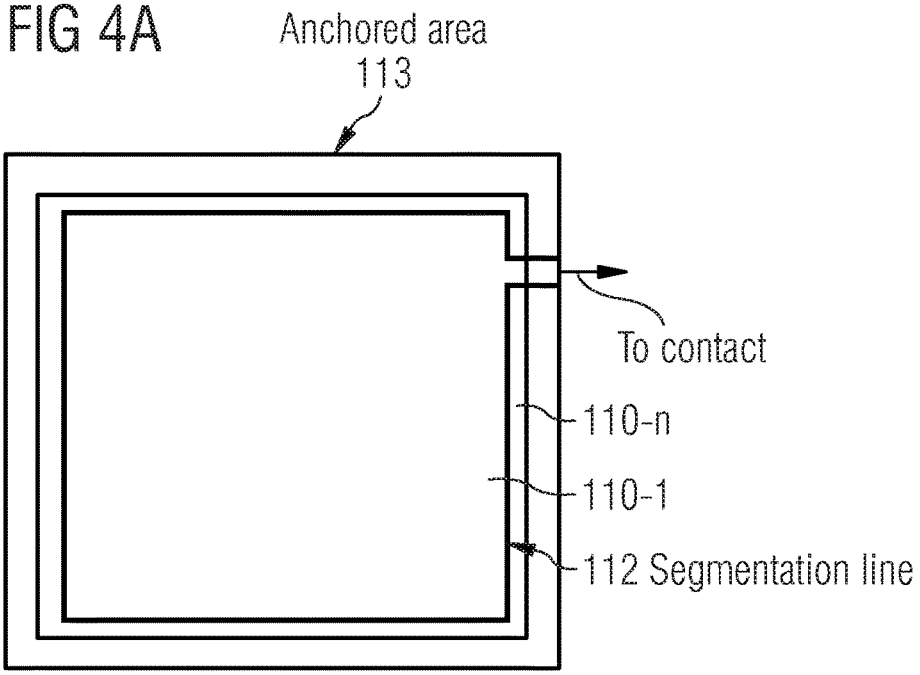
FIGS. 4*a*-4*b* show schematic plane views of multiple segmented first electrode structures comprising multiple segmentation lines in the first and/or second electrode structure according to an embodiment.
Figure 4B:
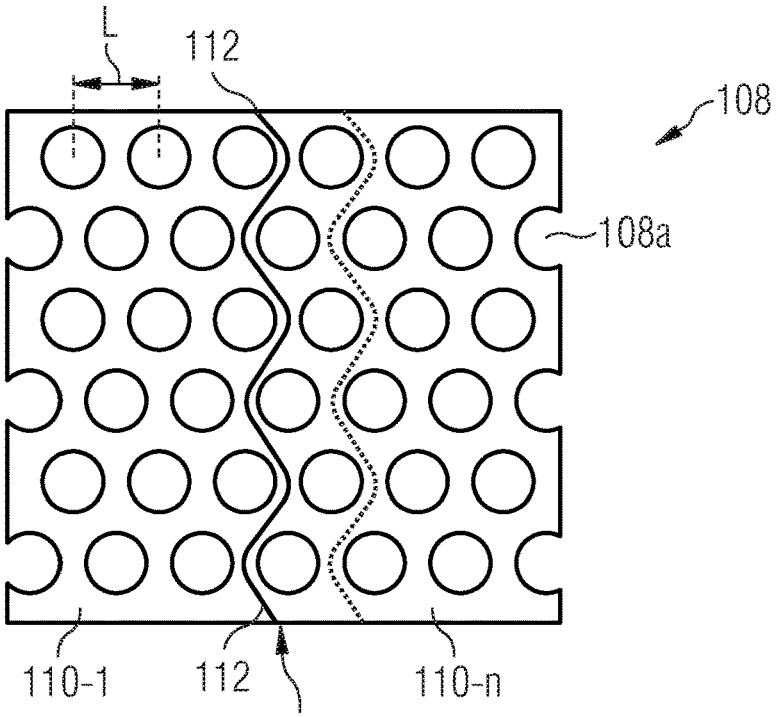

FIGS. 4*a*-4*b* show schematic plane views of the segmented counter electrode structure 108 or of a portion thereof comprising segmentation grooves/gaps 112-1, 112-*m* in the conductive layer 110.

As shown in FIG. 4*a*, the (nearly closed) circumferential narrow gaps 112-1, 112-*m* are arranged in the conductive layer 110, wherein the segmentation areas 112-A, 112-B of the first and second conductive layers 103, 110 may be arranged, in a vertical projection with respect to the plane view of FIG. 4*b*, in an at least partially overlapping or coinciding configuration. The anchored area defines the area of the spacer element 113 between the first electrode structure 102 and the second electrode structure 108.

As shown in FIG. 4*b* with respect to an enlarged partial view of a (perforated) counter electrode structure 108, openings or holes 108*a* may be provided in the conductive layer 110. The holes 108*a* in the conductive layer 110 may be provided due to stress relief reasons, for example. In order to avoid an undesired decrease of the mechanical robustness of the resulting counter electrode structure 108, the circumferential multiple-segmentation structure 112 may have a course, e.g. a sinus-like course, to avoid connecting or intersecting the hole(s) 108*a* in the conductive layers 110 of the counter electrode structure 108. It should be noted that any further appropriate shape, e.g. zig-zag etc., of the respective segmentation lines can be chosen and adapted so that the circumferential narrow gaps 112-1, 112-*m* neither contact nor intersect the holes in the counter electrode structure 108.

The above explanation with respect to the shape of the multiple-segmentation line in the conductive layer 110 is correspondingly applicable to the case when a multiple-segmentation is provided in the first conductive layer 103.

In the following, FIGS. 5*a*-5*g* show schematic cross-sectional views of different implementations of a MEMS sound transducer 200 comprising capacitive MEMS devices 100 and associated schematic circuit diagrams illustrating different readout configurations for the capacitive MEMS device 100. The following explanations are applicable to so-called vacuum MEMS microphones as well as to MEMS microphones having perforated electrode structures.

FIGS. 5*a*-*g* show different schematic circuit diagrams illustrating different, exemplary read out configurations for the above described MEMS device 100 (e.g. MEMS microphone) having an electrode structure with the multiple segmentation 112.

Figure 5A:
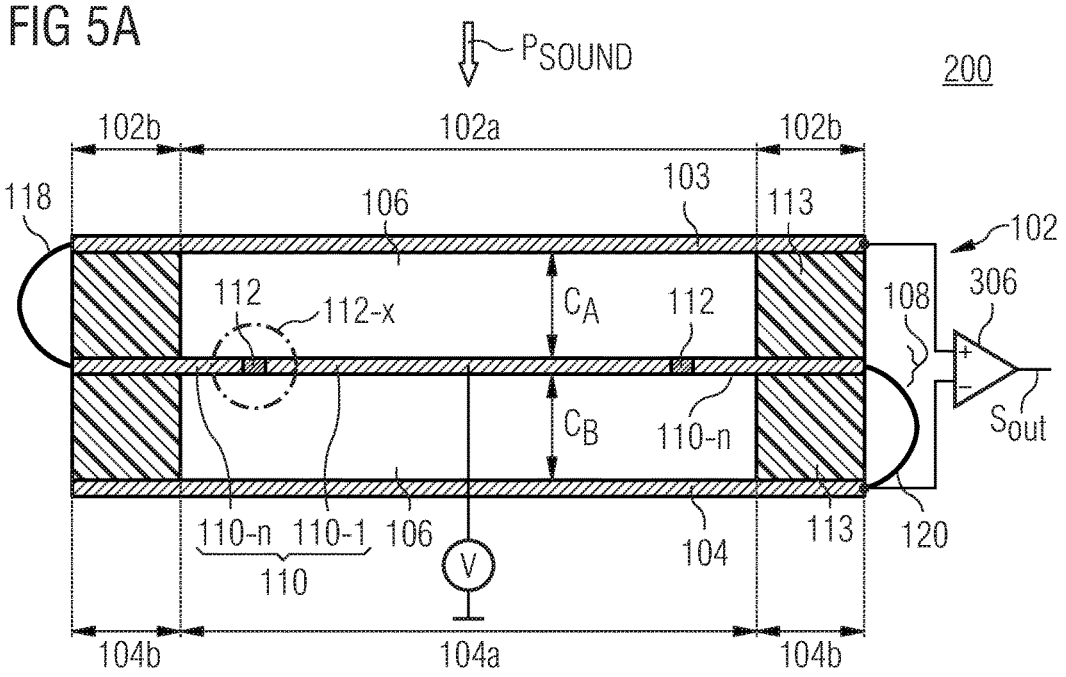

FIG. 5*a* shows a schematic circuit diagram illustrating an exemplary read out configuration for the MEMS device 200, having a multiple-segmented counter electrode structure 108 with one active conductive layer 110. As shown in FIG. 5*a*, the first portion 110-1 of the second conductive layer 110 is connected with a potential V1 so that the first portion 110-1 is polarized with the voltage V1. FIG. 5*a* further illustrates a first electrode structure 102 and a third electrode structure 104. The first electrode structure 102 may comprise a first membrane element. The third electrode structure 104 may comprise a second membrane element. Together the first membrane element 102 and the second membrane element 104 comprise a membrane structure, and may be read out by a differential amplifier 306, wherein the first and second membrane elements 102, 104 are each connected to a different input connection of the differential amplifier 306, which provides the output signal SOUT. The second membrane element 104 may comprise a displaceable or movable portion 104*a* and a fixed portion 104*b*. Thus, FIG. 5*a* provides a differential read out configuration for a vacuum MEMS microphone 200 having one conductive layer. Thus, the amplifier 306 may be configured to read-out or process the signals generated by a deflection of the first membrane element 102 and a deflection of the second membrane element 104 and to provide the output signal SOUT.

With respect to the configuration of FIG. 5*a*, it should be noted that pillars (not shown in FIG. 5*a*) which may be mechanically coupled between the first and second membrane elements 102 and 104 for providing a mechanical coupling between the first and second membrane elements 102, 104 should not provide an electrical connection between the first and second membrane elements 102, 104 to allow the differential read out configuration of the first and second membrane elements 102, 104. Thus, the pillars, which ensure a mechanical coupling between the first and second membrane elements 102, 104, do not provide an electrical connection between the two membrane elements, wherein such pillars can be made of an insulating material, like silicon, nitride, silicon oxide, a polymer or a combination of the former materials, or a combination of the former materials with a conductive layer (for instance silicon), provided the conductive part of the pillars is separated from the membrane elements 102, 104 by an insulating material.

With respect to a differential read out configuration of a MEMS microphone 200 having a single conductive layer 110 as the counter electrode structure 108, it should be noted that the (single) conductive layer 110, i.e. the counter electrode, is split into an outer part 110-*n* and an inner part 110-1. Thus, the outer part 110-*n* of the single conductive layer 110 is respectively electrically connected to one of the movable membrane elements 102, 104 to avoid a shorting of the two membrane elements 102, 104. By biasing the inner part 110-1 of the counter electrode 110, the two membrane elements 102, 104 can be differentially read out.

As an alternative and possible implementation, the movable membrane element 102 may be electrically connected to the outer part 110-*n* of the single conductive layer 110 (e.g. in one part), wherein the further membrane element 104 is not electrically connected to the outer part 110-*n* of the single conductive layer 110. As a further possible implementation, the movable membrane element 104 may be electrically connected to the outer part 110-*n* of the single conductive layer 110 (e.g. in one part), wherein the further membrane element 102 is not connected to the outer part 110-*n* of the single conductive layer 110.

Figure 5B:
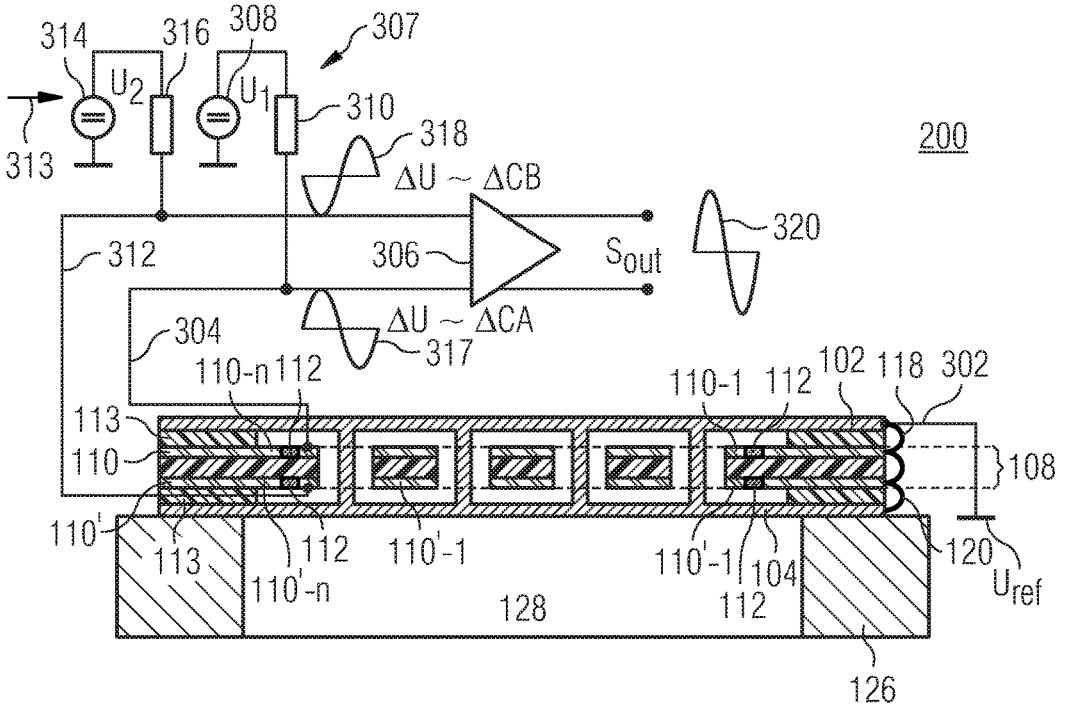

FIG. 5*b* schematically illustrates an example of how the MEMS microphone 200 may be electrically connected to a power supply circuit and a read out amplifier. The MEMS microphone 200 may have a dual (second) conductive layer 110, 110' as the multiple-segmented counter electrode structure (second electrode structure) 108. The conductive layers 110, 110' are split into an outer part 110-*n*, 110'-*n*, an intermediate part (not shown in FIG. 5*b*) and an inner part 110-1, 110'-1, respectively. FIG. 5*b* shows an example of a possible connection, wherein other arrangements and configurations may be possible as well. The MEMS microphone may be formed on a surface of a substrate 126. A recess or hole 128 in the substrate 126 forms the backside cavity 128 adjacent to the second membrane element 104.

In FIG. 5*b* the first and second membrane elements 102, 104 may be connected (e.g. grounded) by a membrane connection 302 to an electric reference potential VREF (e.g. ground potential). The first portion 110-1 of the conductive layer 110 may be electrically connected to a first connection 304 to a first power supply circuit 307 and also to a first input of an amplifier 306. The first power supply circuit 307 comprises a voltage source 308 (providing a first potential V1) and a resistor 310 having a very high resistance (several Giga-Ohms or higher). The amplifier 306 may be a differential amplifier. The first portion 110'-1 of the conductive layer 110' may be connected to a second connection 312 to a second power supply circuit 313 and a second input of the amplifier 306. The second power supply circuit 313 comprises a second voltage source 314 (providing a second potential V2) and a second resistor 316 that typically has about the same resistance as the first resistor 310. The first and second power supply circuits 307, 313 electrically bias the first portions 110-1, 110'-1 of the dual conductive layer 110, 110', respectively, against the electric reference potential VREF (e.g. ground potential).

When the membrane structure is deflected in response to the arriving sound pressure, the electrical potentials at the first portions 110-1, 110'-1 of the dual conductive layer 110, 110' may vary in opposite directions due to the varying capacitances CA, CB between the first membrane element 102 and the first portion 110-1 of the conductive layer 110 and between the second membrane element 104 and the first portion **110'-*i* of the conductive layer 110', respectively. This is schematically illustrated in FIG. 5*b* by a first waveform 317 and a second waveform 318 which may be fed in the first and second input, respectively of the amplifier 306. The amplifier 306 may generate an amplified output signal 320 based on the input signals 304 and 312, in particular a difference of the input signals. The amplified output signal 320 may then be supplied to further components for a subsequent signal processing, for example analog-to-digital conversion, filtering, etc. Thus, the amplifier 306 may be configured to read-out or process the signals 304, 312 generated by a deflection of the first membrane element 102 and a deflection of the second membrane element 104** and to provide the output signal SOUT.

Figure 5C:
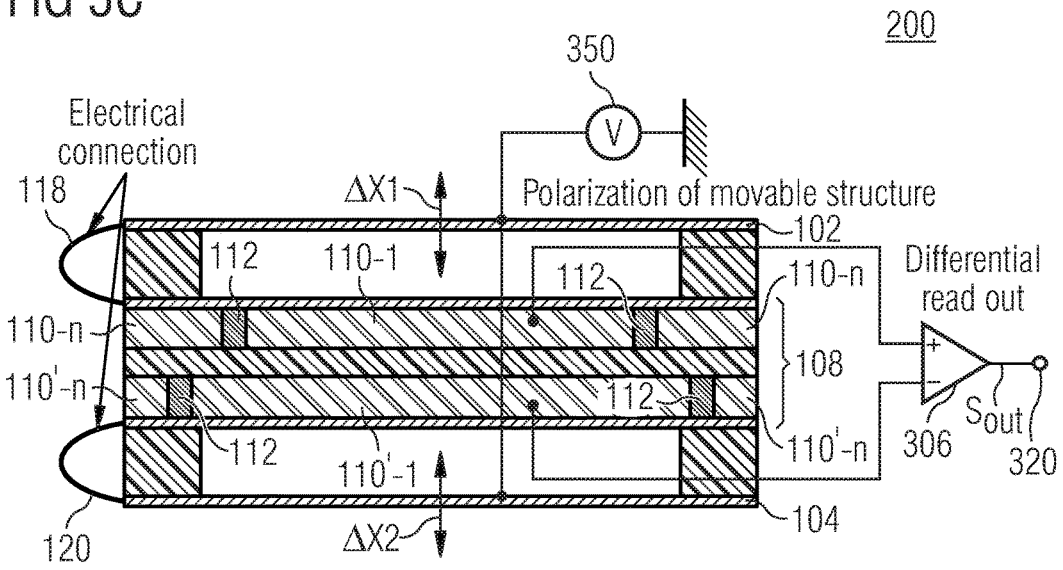

FIG. **5*c* shows a schematic circuit diagram for a further exemplary read out configuration for the MEMS device 200. The MEMS device 200 may have a dual (second) conductive layer 110, 110' as the multiple-segmented counter electrode structure (second electrode structure) 108. The conductive layers 110, 110' are split into an outer part 110-*n*, 110'-*n*, an intermediate part (not shown in FIG. 5*c*) and an inner part 110-1, 110'-1, respectively. As shown in FIG. 5*c*, the first and second membrane elements 102, 104 are connected with a voltage source 350 to apply a reference potential V for the first and second membrane elements 102, 104. This provides a polarization with the potential V of the membrane structure, i.e. the first and second membrane elements 102, 104. Furthermore, the first portions 110-1, 110'-1 of the dual conductive layer 110, 110' are respectively connected to different input connections of a differential amplifier 306 for providing a differential read out configuration of the capacitive MEMS device 200 (MEMS microphone). Thus, according to the configuration of FIG. 5*c*, a deflection of the membrane structure 102, 104 may occur in response to an arriving sound pressure/sound signal, and corresponding output signal SOUT may be provided by the amplifier 306 indicative of the deflection of the membrane structure 102, 104. Thus, the amplifier 306 may be configured to read-out or process the signals generated by a deflection of the first membrane element 102 and a deflection of the second membrane element 104** and to provide the output signal SOUT.

Thus, the movable part 102, 104 (i.e. the first and second membrane elements 102, 104) are polarized with a voltage V1, wherein a differential sensing/read out is conducted on the static electrode 108, i.e. the first portions 110-1, 110'-1 of the dual conductive layer 110, 110'.

Figure 5D:
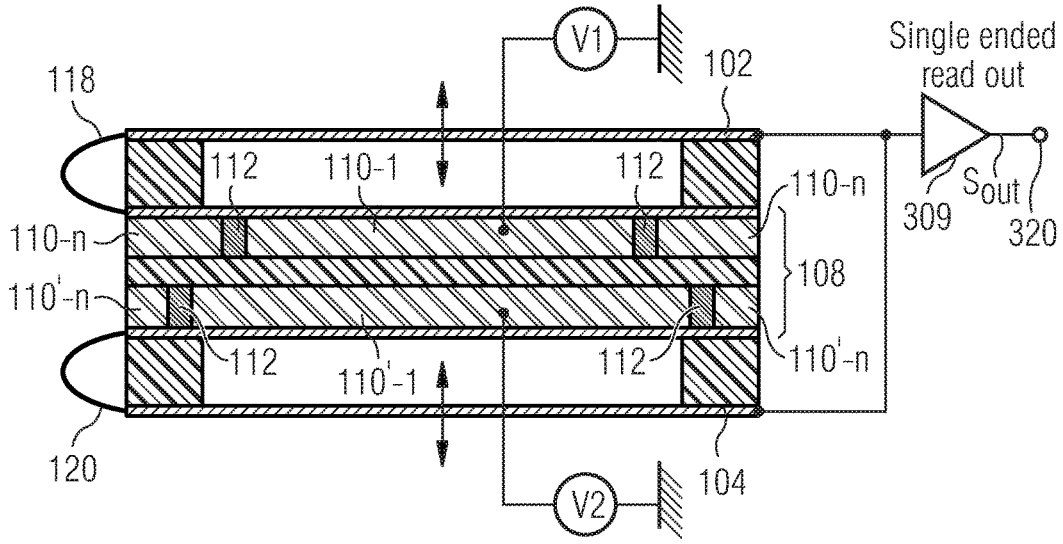

FIG. **5*d* shows a schematic circuit diagram of a further illustrative read out configuration for the MEMS device 200. The MEMS microphone 200 may have a dual (second) conductive layer 110, 110' as the multiple-segmented counter electrode structure (second electrode structure) 108. The conductive layers 110, 110' are split into an outer part 110-*n*, 110'-*n*, an intermediate part (not shown in FIG. 5*d*) and an inner part 110-1, 110'-1, respectively. To be more specific, as shown in FIG. 5*d*, the first portion 110-1 of the conductive layer 110 is connected to a first potential V1, i.e. is polarized (biased) with a first voltage V1, wherein the first portion 110'-*i* of the conductive layer 110' is connected to a second potential V2, so that the first portion 110'-*i* of the conductive layer 110' is polarized with the second voltage V2**.

The membrane structure 102, 104, i.e. the first and second membrane elements 102, 104, are connected to a common input connection of a (single-ended) amplifier 309 for providing the amplified output signal SOUT based on a single-ended read out configured. Due to the polarization of the first portions 110-1, 110'-1 of the dual conductive layer 110, 110', a deflection of the membrane structure 102, 104 results in electrical potentials at the first and second membrane elements 102, 104 which can be fed in a superimposed manner to an input of the amplifier 309.

To summarize, the two electrodes (the first portions 110-1, 110'-1 of the dual conductive layer 110, 110') of the static membrane (the counter electrode structure 108) are polarized (biased) with different voltages V1, V2, for example to opposite voltages with V2=−V1. Thus, the membrane structure can be read out based on a single-ended amplifier configuration (single-ended read out). The amplifier 309 may be configured to read-out or process the signals generated by a deflection of the first membrane element 102 and a deflection of the second membrane element 104 and to provide the output signal SOUT.

FIG. **5*e* shows a schematic circuit diagram illustrating an exemplary read out configuration for the MEMS device 400 as shown in FIG. 1*d*. The MEMS device (vacuum MEMS microphone) 400 comprises the multiple-segmented first membrane element 402, the multiple-segmented second membrane element 404, which is spaced apart from the multiple-segmented first membrane element 402, and the counter electrode structure 408 comprising the conductive layer 410 which is at least partially arranged between the multiple-segmented first and second membrane elements 402, 404. The second portion 402-*n* of the first membrane element 402 and the second portion 404-*n* of the second membrane element 404 may be electrically connected by the first and second connection 422, 423 with the conductive layer 410**.

For instance, for MEMS device 400 in FIG. **1*d*, the conductive layer 410 can be polarized, i.e. provided with a reference potential V from a voltage source 350, wherein the first portion 402-1 of the first membrane elements 402 and the first portion 404-1 of the second membrane element 404 (not electrically connected) can be differentially read out by a differential amplifier 306. Thus, the amplifier 306 may be configured to read-out or process the signals generated by a deflection of the first membrane element 402 and a deflection of the second membrane element 404** and to provide the output signal SOUT.

Alternatively (not shown), the first and second membrane elements 402, 404, more specifically the first portion of the first membrane element 402-1 and the first portion of the second membrane element 404-1, can be polarized, i.e. provided with a reference potential V from the voltage source 350, wherein the conductive layer 410 can be single ended read out.

Figure 5E:
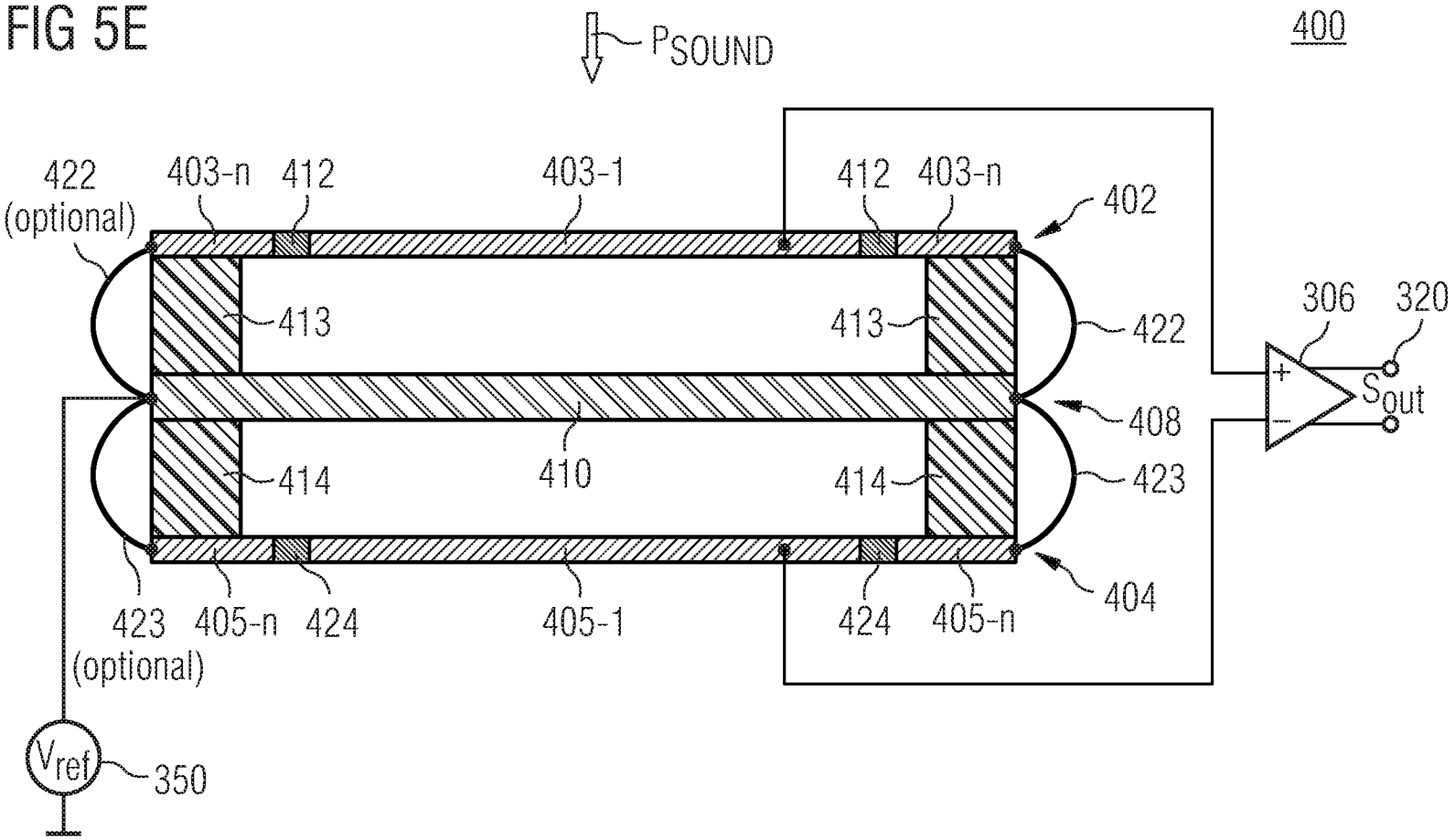
Figure 5F:
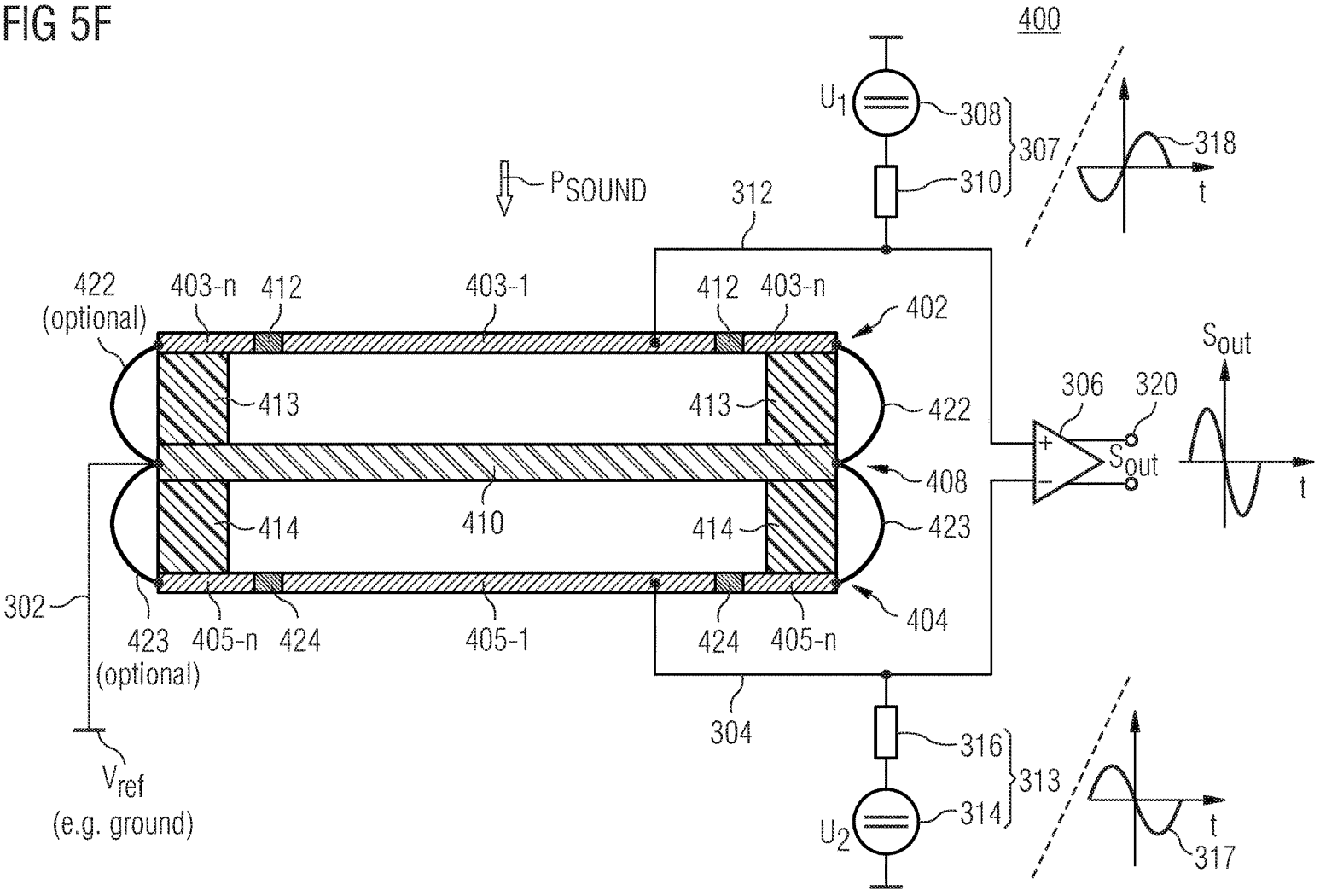

FIG. 5*f* shows a schematic circuit diagram illustrating an exemplary read out configuration for the MEMS device 400 as shown in FIG. 1*d*, wherein the MEMS device 200 may be electrically connected to a power supply circuit and a read out amplifier. The MEMS device (vacuum MEMS microphone) 400 comprises the multiple-segmented first membrane element 402, the multiple-segmented second membrane element 404, which is spaced apart from the multiple-segmented first membrane element 402, and the counter electrode structure 408 comprising the conductive layer 410 which is at least partially arranged between the multiple-segmented first and second membrane elements 402, 404. The second portion 403-*n* of the first membrane element 402 and the second portion 405-*n* of the second membrane element 404 may be electrically connected by a first and second connection 422, 423 with the conductive layer 410 of the counter electrode structure 408.

In FIG. 5*f* the counter electrode structure 408 (and the second portion 403-*n* of the first membrane element 402 and the second portion 405-*n* of the second membrane element 404) may be connected (e.g. grounded) by a membrane connection 302 to an electric reference potential VREF (e.g. ground potential).

The first portion 403-1 of the first membrane element 402 may be electrically connected to a first connection 312 to a first power supply circuit 307 and also to a first input of an amplifier 306. The first power supply circuit 307 comprises a voltage source 308 (providing a first potential V1) and a resistor 310 having a high resistance (e.g. several Giga-Ohms or higher). The amplifier 306 may be a differential amplifier.

The first portion 405-1 of the second membrane element 404 may be electrically connected to a second connection 304 to a second power supply circuit 313 and a second input of the amplifier 306. The second power supply circuit 313 comprises a second voltage source 314 (providing a second potential V2) and a second resistor 316 that typically has about the same resistance as the first resistor 310. The first and second power supply circuits 307, 313 electrically bias the first portions 403-1, 405-1 of the first and second membrane elements 402, 404, respectively, against the electric reference potential VREF (e.g. ground potential).

When the membrane structure is deflected in response to the arriving sound pressure $P_{SOUND}$, the electrical potentials at the first portions 403-1, 405-1 of the first and second membrane elements 402, 404 may vary in opposite directions due to the varying capacitances CA, CB between the first portion 403-1 of the first membrane element 402 and the conductive layer 410 and between the first portion 405-1 of the second membrane element 404 and the conductive layer 110, respectively. This is schematically illustrated in FIG. 5*f* by a first waveform 318 and a second waveform 317 which may be fed in the first and second input, respectively of the amplifier 306. The amplifier 306 may generate an amplified output signal 320 based on the input signals 304 and 312, in particular a difference of the input signals. The amplified output signal 320 may then be supplied to further components for a subsequent signal processing, for example analog-to-digital conversion, filtering, etc.

To summarize for the MEMS device 400 in FIG. 1*e*, the first portion 403-1 of the first membrane elements 402 and the first portion 405-1 of the second membrane element 404 (not being electrically connected) can be polarized differently, i.e. provided with different reference potentials V1, V2, wherein the first portion 403-1 of the first membrane elements 402 and the first portion 405-1 of the second membrane element 404 can be differentially read out. Thus, the amplifier 306 may be configured to read-out or process the signals 304, 312 generated by a deflection of the first membrane element 402 and a deflection of the second membrane element 404 and to provide the output signal SOUT.

As indicated above, the counter electrode structure 408 may comprise at least one conductive layer 410, 411, so that the above explanations with respect to FIGS. 5*e*-5*f* are equally applicable to an arrangement having a counter electrode structure with two electrically isolated/insulated conductive layers, for example the dual conductive layer 410, 411 as shown in FIG. 1*e*.

FIG. 5*g* shows a schematic circuit diagram of a further illustrative read out configuration for the MEMS device 100 of FIGS. 1*a*-1*b*. To be more specific, as shown in FIG. 5*g*, the first portion 110-1 of the second conductive layer 110 is connected to a first potential V1, i.e. is polarized (biased) with a first voltage V1, wherein the first conductive layer 103 is connected to a common input connection of a (single-ended) amplifier 309 for providing the amplified output signal SOUT based on a single-ended read out configured. The second portion 110-*n* of the conductive layer 110 is electrically coupled by means of an electrical connection element 118 to the first conductive layer 103 of the membrane element 102. Due to the polarization of the first portion 110-1 of the second conductive layer 110, a deflection of the first or the second conductive layer 103, 110 results in a change of electrical potential at the first conductive layer 103 which can be fed to an input of the amplifier 309. Thus, the amplifier 309 may be configured to read-out or process the signal generated by a deflection of the first membrane element 102 and to provide the output signal SOUT.

A further embodiment provides a method of operating a capacitive MEMS device 100, wherein the capacitive MEMS device comprises a first electrode structure 102 comprising a first conductive layer 103, and a second electrode structure 108 comprising a second conductive layer 110, wherein the second conductive layer 110 at least partially opposes the first conductive layer 103, wherein the second conductive layer 110 comprises a multiple segmentation 112 which provides an electrical isolation between at least three portions of the second conductive layer 110. The method comprises the step of single-ended reading out the first electrode structure 102, and polarizing (biasing) the first portion 110-1 of the second conductive layer 110 with a reference potential V1.

Alternatively, The method may comprise the step of single-ended reading out the first portion 110-1 of the second conductive layer 110, and polarizing (biasing) the first electrode structure 102 with a reference potential V1.

In FIG. 6, a further embodiment provides a method 500 of operating a capacitive MEMS device 100, 200, 400, wherein the capacitive MEMS device comprises a first electrode structure comprising a first conductive layer, and a second electrode structure comprising a second conductive layer, wherein the second conductive layer at least partially opposes the first conductive layer, wherein the second conductive layer comprises a multiple segmentation which provides an electrical isolation between at least three portions of the second conductive layer, the method comprising the step 510 of single-ended or differentially reading out the second electrode structure.

In a further embodiment according to the read-out configuration as shown, for example, in FIG. 5*e*, the capacitive MEMS device 400 further comprises a third electrode structure 404 comprising a third conductive layer 405, wherein the third conductive layer 405 comprises a further multiple segmentation 424 which provides an electrical isolation between at least a first portion 405-1, a second portion 405-*n* and a third portion 405-2 of the third conductive layer 405, wherein the first portion 405-1 is a center portion of the third conductive layer 405, the second portion 405-*n* is a boundary portion of the third conductive layer 405, and the third portion 405-2 is an intermediate portion of the third conductive layer 405 between the first and second portions 405-1, 405-*n* of the third conductive layer 405, and wherein the second conductive layer 403 comprises a first membrane element 402 and the third conductive layer 405 comprises a second membrane element 404, the method further comprising the steps of polarizing (biasing) the first conductive layer 410 with a reference potential Vref, and differentially reading-out the first portion 403-1 of the first membrane element 402 and the first portion 405-1 of the second membrane element 404.

In a further alternative embodiment according to the read-out configuration as shown, for example, in FIG. 5*f*, the capacitive MEMS device 400 further comprises a third electrode structure 404 comprising a third conductive layer 405, wherein the third conductive layer 405 comprises a further multiple segmentation 424 which provides an electrical isolation between at least a first portion 405-1, a second portion 405-*n* and a third portion 405-2 of the third conductive layer 405, wherein the first portion 405-1 is a center portion of the third conductive layer 405, the second portion 405-*n* is a boundary portion of the third conductive layer 405, and the third portion 405-2 is an intermediate portion 405 of the third conductive layer 405 between the first and second portions 405-1, 405-*n* of the third conductive layer 405, and wherein the second conductive layer 403 comprises a first membrane element 402 and the third conductive layer 405 comprises a second membrane element 404, the method further comprising the steps of polarizing the first portion 403-1 of the first membrane element 402 with a first reference potential V1, and polarizing the first portion 405-1 of the second membrane element 405 with a second reference potential V2, and differentially reading-out the first portion 403-1 of the first membrane element 402 and the first portion 405-1 of the second membrane element 404.

In a further embodiment, the first portion 403-1 of the first membrane element 402 and the first portion 405-1 of the second membrane element 404 are not electrically connected, and the first and second reference potentials V1, V2 are different.

Thus, according to embodiments, the read-out circuit 306, 309 is configured to read-out or process at least one signal of the capacitive MEMS device 400, wherein the at least one signal is generated by a deflection of the first membrane element 402 or by a deflection of the first and second membrane elements 402, 404.

FIGS. 7*a*-7*f* show an exemplary process flow 600 of a manufacturing method of forming a capacitive MEMS device according to an embodiment. FIGS. 7*a*-7*f* show schematic cross-sections associated during various stages or steps of an example manufacturing process of a MEMS device 100 as described above.

Figure 7A:
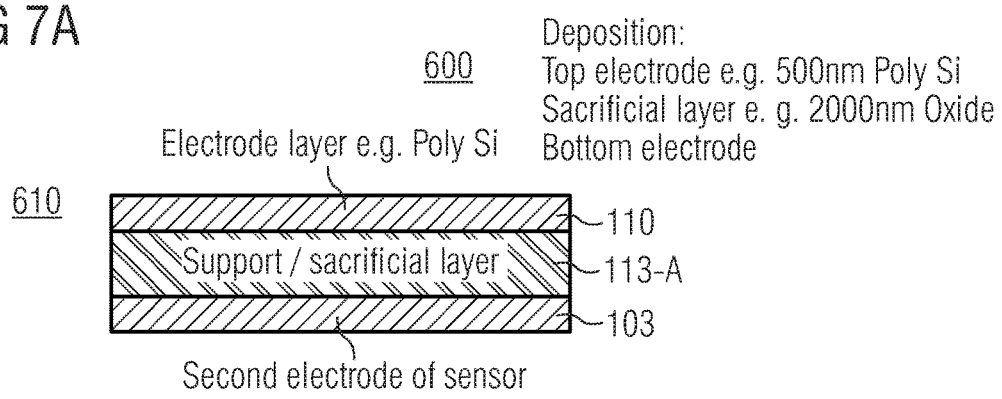
FIGS. 7*a*-*f* show an exemplary process flow of a manufacturing method of forming a capacitive MEMS device according to an embodiment.

As shown in FIG. 7*a* of the method 600 of forming a capacitive MEMS device, in step 610, a first conductive layer 103, a second conductive layer 110 and a support layer 113-A lying in between the first and second conductive layer 103, 110 are provided in a stacked configuration.

As shown in FIG. 7*a*, the second conductive layer 110 (electrode layer or top electrode) may comprise a Poly-Si material, which may have a thickness of about 500 nm (or between 300 and 700 nm), for example. The support layer (sacrificial layer) 113-A may comprise an oxide or nitride material, which is, for example, may have a thickness of about 2000 nm (or between 1500 and 2500 nm), for example. The first conductive layer 103 (backplate or counter electrode) may comprise a Poly-Si material, which may have a thickness of about 500 nm (or between 300 and 700 nm), for example.

Figure 7B:
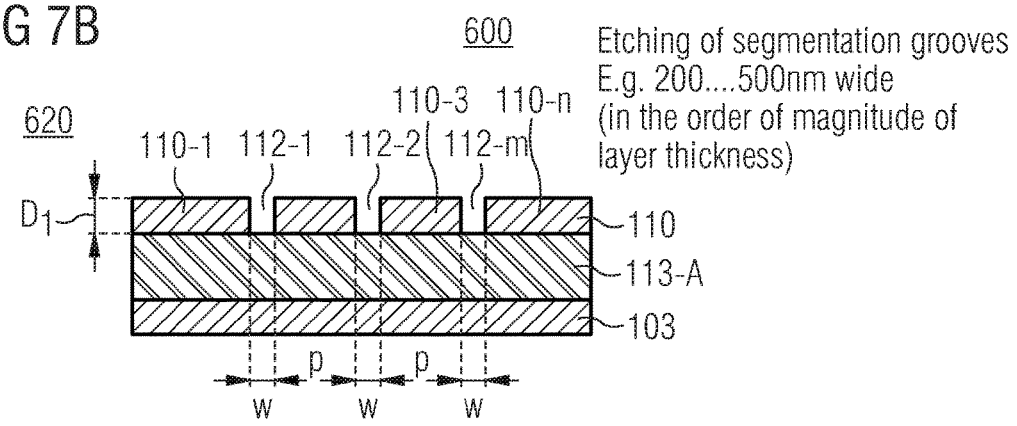

As shown in step 620 of FIG. 7*b*, a plurality of gaps 112-1, 112-*m* are formed in the second conductive layer 110 for providing an electrical isolation (i.e. the multiple segmentation 112) between at least three portions 110-1, 110-2, 110-3, 110-*n* of the second conductive layer 110. The gaps 112-1, 112-*m* may be formed by etching (e.g. wet etching) segmentation grooves in the conductive layer 110. The gaps 112, 112-*m* may have a width W between 200 to 500 nm (or 100 to 1000 nm), e.g. in the order of magnitude of layer 110 thickness. The second conductive layer 110 may have in the segmentation area 112-A a thickness "$D_1$", wherein the gaps 112-1, 112-*m* have a width "W" between $D_1/2$ and $2*D_1$, wherein W may be typically in the range of $D_1$ ($D_1 \approx W$). The gaps 112-1, 112-*m* have a pitch "P" of about 700 nm (or between 400 and 1000 nm), for example. The thickness $D_1$ of second conductive layer 110 in the segmentation area 112-A may be between 200 nm and 1000 nm, and may be (approximately) 500 nm.

Figure 7C:
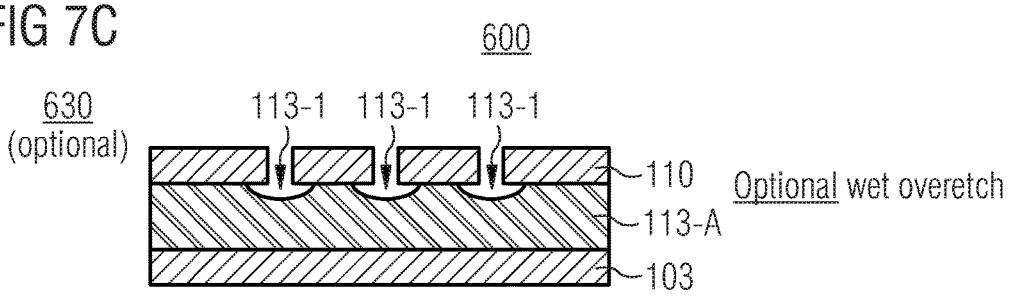

As shown in "optional" step 630 of FIG. 7*c*, an optional "(wet) over-etching" into the support/sacrificial layer may be conducted to form "optional" (rivet head shaped) voids 113-1 in the support layer (sacrificial layer) 113-A, wherein the voids in the support layer 113-A are below the gaps 112-1, 112-*m* in the second conductive layer 110.

Figure 7D:
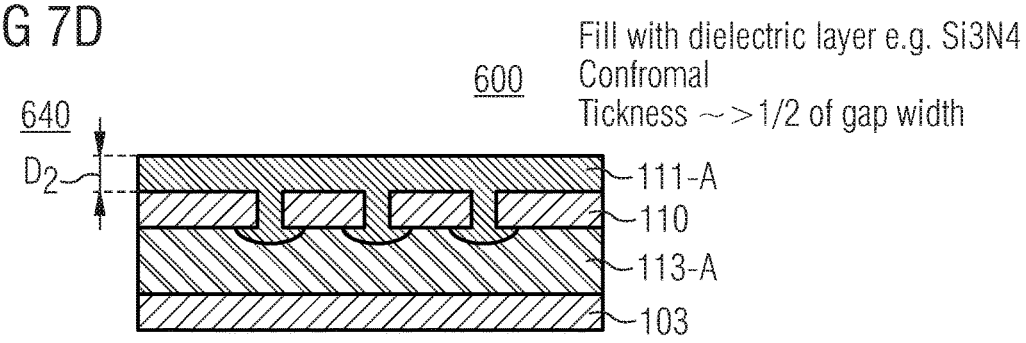

As shown in step 640 of FIG. 7*d*, a dielectric layer ill-A is deposited onto the second conductive layer 110 and into the gaps 112-1, 112-*m* in the second conductive layer 110. The dielectric layer ill-A may comprise a dielectric material, such as Si3N4. The dielectric material of the non-conductive connecting structure 111 has a thickness D2 of between 100 to 1000 nm. In the step 640 of depositing the dielectric layer, the dielectric layer may be deposited to have a thickness of at least half of the width of the gaps 112-1, 112-*m*. In the step of depositing the dielectric layer, the dielectric layer may be deposited with a deposition thickness to close the gaps, e.g. to completely fill the gaps with the material of the non-conductive connecting structure. In the step 640 of depositing the dielectric layer, the dielectric layer alternatively may be conformally deposited onto the second conductive layer 110 and into the gaps 112-1, 112-*m* of the second conductive layer.

Figure 7E:
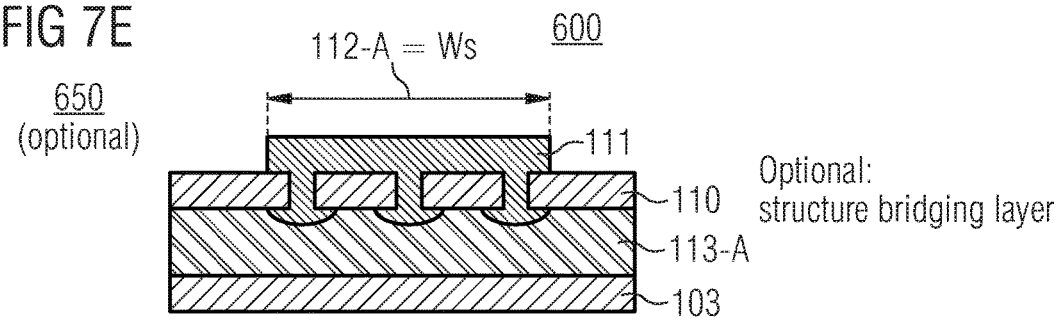

As shown in "optional" step 650 of FIG. 7*e*, the dielectric layer may be optionally structured to provide for the connecting, non-conductive structure for mechanically connecting the isolated portions 110-1 . . . 110-*n* of the second conductive layer 110. The resulting "cover" of the segmentation may have a width WS of about 3 μm or between 2 to 4 μm.

Figure 7F:
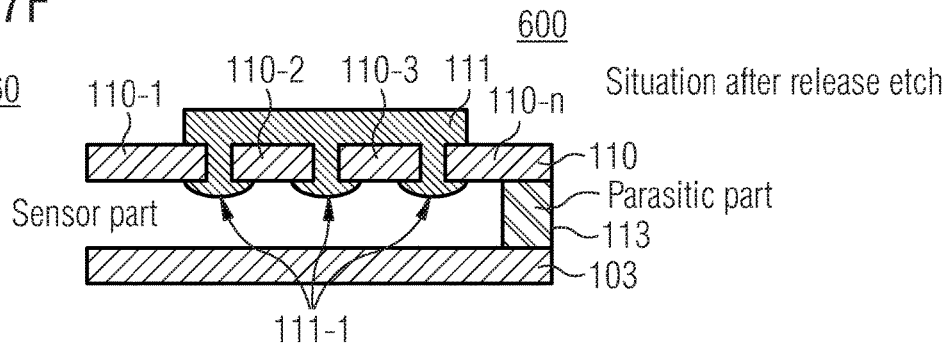

As shown in step 660 of FIG. 7*f*, the support material is partially between the first and second conductive layer so that the support structure 113 remains in a peripheral (anchoring) area of the first and second conductive layers.

Thus, FIG. 7*f* essentially shows a partial view of the border region of the capacitive MEMS device of FIG. 1*a*. As it can be seen from FIG. 7*f*, the center part of the device essentially contributes to the sensor part, wherein the border (fringe) part of the device essentially contributes to the parasitic part of the capacitive MEMS device 100.

According to a first aspect, a capacitive MEMS device may comprise a first electrode structure comprising a first conductive layer, and a second electrode structure comprising a second conductive layer, wherein the second conductive layer at least partially opposes the first conductive layer, wherein the second conductive layer comprises a multiple segmentation which provides an electrical isolation between at least three portions of the second conductive layer.

According to a second aspect when referring back to the first aspect, the multiple segmentation of the second conductive layer may comprise a plurality of gaps in the second conductive layer, one gap providing an electrical isolation between two neighboring portions of the second conductive layer, and a non-conductive connecting structure having an isolating material for mechanically connecting the neighboring portions of the second conductive layer.

According to a third aspect when referring back to the second aspect, the gaps may be arranged in a circumferential region in the second conductive layer.

According to a fourth aspect when referring back to the second or third aspect, the gaps may be arranged in an equidistant configuration to each other in the second conductive layer.

According to a fifth aspect when referring back to the second to fourth aspects, the gaps in the second conductive layer may be arranged in a segmentation area of the second conductive layer, wherein the segmentation area is formed in a circumferential, border region of the second conductive layer.

According to a sixth aspect when referring back to the second to fifth aspects, the gaps may each have a width of between 100 to 1000 nm or 200 to 500 nm.

According to a seventh aspect when referring back to the fifth and sixth aspect, the second conductive layer may have a thickness "$D_1$" in the segmentation area, and the gaps may a width "W" between $D_1/2$ and $2*D_1$.

According to an eighth aspect when referring back to the second to seventh aspects, the gaps may be completely filled with the material of the non-conductive connecting structure.

According to a ninth aspect when referring back to the second to eighth aspects, the non-conductive connecting structure may have a thickness of between 100 to 1000 nm.

According to a tenth aspect when referring back to the first to ninth aspects, the multiple segmentation may provide an electrical isolation between a first portion, a second portion and a third portion of the second conductive layer, wherein the first portion is a center portion of the second conductive layer, the second portion is a boundary portion of the second conductive layer, and the third portion is an intermediate portion of the second conductive layer between the first and second portions of the second conductive layer.

According to an eleventh aspect when referring back to the tenth aspect, the second portion of the second conductive layer may be at least partially supported by a mechanical support structure.

According to a twelfth aspect when referring back to the tenth or eleventh aspect, the first portion of the second conductive layer may form an displaceable area of the second electrode structure.

According to a thirteenth aspect when referring back to the first to twelfth aspects, the multiple segmentation may comprise a double segmentation with two gaps and with one intermediate portion of the second conductive layer between the first and second portions of the second conductive layer.

According to a fourteenth aspect when referring back to the first to thirteenth aspects, the multiple segmentation may comprise a triple segmentation with two neighboring intermediate portions of the second conductive layer, wherein the triple segmentation has three gaps.

According to a fifteenth aspect when referring back to the fourteenth aspect, the triple segmentation may provide an electrical isolation between a first portion, a second portion, a third portion and a fourth portion of the second conductive layer, wherein the first portion is a center portion of the first conductive layer, the second portion is a boundary portion of the second conductive layer, and the third and fourth portions are neighboring intermediate portions of the second conductive layer between the first and second portion of the second conductive layer.

According to a sixteenth aspect when referring back to the first to fifteenth aspects, the multiple segmentation may comprise a quad segmentation with three neighboring intermediate portions of the second conductive layer, wherein the quad segmentation has four gaps.

According to a seventeenth aspect when referring back to the sixteenth aspect, the quad segmentation may provide an electrical isolation between a first portion, a second portion, a third portion, a fourth portion and a fifth portion of the second conductive layer, wherein the first portion is a center portion of the first conductive layer, the second portion is a boundary portion of the first conductive layer, and the third, fourth and fifth portions are neighboring intermediate portions of the second conductive layer between the first and second portions of the second conductive layer.

According to an eighteenth aspect when referring back to the first to seventeenth aspects, a boundary portion of the second electrode structure may be supported by a support structure and retained in a spaced apart position from the first electrode structure.

According to a nineteenth aspect when referring back to the first to eighteenth aspects, the first conductive layer of the first electrode structure may form a membrane, wherein the second conductive layer of the second electrode structure forms a counter electrode with respect to the membrane.

According to a twentieth aspect when referring back to the first to nineteenth aspects, a deflection of the first conductive layer of the first electrode structure with respect to the second conductive layer of the second electrode structure may result in a change of capacitance between the first and second electrode structure.

According to a twenty-first aspect when referring back to the first to twentieth aspects, the first conductive layer may comprise a further multiple segmentation which provides an electrical isolation between at least three portions of the first conductive layer.

According to a twenty-second aspect when referring back to the twenty-first aspect, the further multiple segmentation may provide an electrical isolation between a first portion, a second portion and a third portion of the first conductive layer, wherein the first portion is a center portion of the first conductive layer, the second portion is a boundary portion of the first conductive layer, and the third portion is an intermediate portion of the first conductive layer between the first and second portions of the first conductive layer.

According to a twenty-third aspect when referring back to the twenty-first or twenty-second aspect, the plurality of gaps in the first conductive layer may be arranged in a first segmentation area of the first conductive layer, wherein the plurality of gaps in the second conductive layer is arranged in a second segmentation area of the second conductive layer, and wherein the first segmentation area and the second segmentation area are arranged, in a vertical projection, in an at least partially overlapping configuration.

According to a twenty-fourth aspect when referring back to the first to twenty-third aspects, the capacitive MEMS device may further comprise a third electrode structure comprising a third conductive layer.

According to a twenty-fifth aspect when referring back to the twenty-fourth aspect, the third conductive layer may comprise a further multiple segmentation which provides an electrical isolation between at least a first portion, a second portion and a third portion of the third conductive layer, the first portion may be a center portion of the third conductive layer, the second portion may be a boundary portion of the third conductive layer, and the third portion may be an intermediate portion of the third conductive layer between the first and second portions of the third conductive layer, and the second conductive layer may comprise a first membrane element and the third conductive layer may comprise a second membrane element.

According to a twenty-sixth when referring back to the twenty-fifth aspect, the capacitive MEMS device may further comprise a reference potential source for polarizing the first conductive layer with a reference potential V, and a read out circuit for differentially reading-out the first portion of the first membrane elements and the first portion of the second membrane element.

According to a twenty-seventh aspect when referring back to the twenty-fifth aspects, the capacitive MEMS device may further comprise a first reference potential source for polarizing the first portion of the first membrane element with a first reference potential V1, and a second reference potential source for polarizing the first portion of the second membrane element with a second reference potential V2, and a read out circuit for differentially reading-out the first portion of the first membrane elements and the first portion of the second membrane element.

According to a twenty-eighth aspect when referring back to the twenty-eighth aspect, the first portion of the first membrane element and the first portion of the second membrane element may not be electrically connected, and the first and second reference potentials V1, V2 may be different.

According to a twenty-ninth aspect, a MEMS microphone may have a capacitive MEMS device according to the first to twenty-eighth aspect, wherein a displacement of the first conductive layer of the first electrode structure with respect to the second conductive layer of the second electrode structure may be effected by an incident sound pressure change.

According to a thirtieth aspect, a method of forming a capacitive MEMS device may have: providing, in a stacked configuration, a first conductive layer, a second conductive layer and a support layer lying in between the first and second conductive layer, forming a plurality of gaps in the second conductive layer for providing an electrical isolation between at least three portions of the second conductive layer, depositing a dielectric layer onto the second conductive layer and into the gaps in the second conductive layer, and partially removing the support material between the first and second conductive layer so that a support structure remains in a peripheral area of the first and second conductive layers.

According to a thirty-first aspect when referring back to the thirtieth aspect, the method may further comprise over-etching into the support/sacrificial layer.

According to a thirty-second aspect when referring back to the thirtieth or thirty-first aspect, the method may further comprise structuring the dielectric layer for providing a connecting, non-conductive structure for mechanically connecting the isolated portions of the second conductive layer.

According to a thirty-third aspect when referring back to the thirtieth to thirty-second aspects, in the step of depositing the dielectric layer, the dielectric layer may be deposited with a deposition thickness to close the gaps.

According to a thirty-fourth aspect when referring back to the thirtieth to thirty-third aspects, in the step of depositing the dielectric layer, the dielectric layer may be conformal deposited onto the second conductive layer and into the gaps in the second conductive layer.

According to a thirty-fifth aspect when referring back to the thirtieth to thirty-fourth aspects, in the step of depositing the dielectric layer, the dielectric layer may be deposited to have a thickness of at least the half of the width of the gaps.

According to a thirty-sixth aspect, a method of operating a capacitive MEMS device, wherein the capacitive MEMS device comprises a first electrode structure comprising a first conductive layer, and a second electrode structure comprising a second conductive layer, wherein the second conductive layer at least partially opposes the first conductive layer, wherein the second conductive layer comprises a multiple segmentation which provides an electrical isolation between at least three portions of the second conductive layer, may have: single-ended or differentially reading out the second electrode structure.

According to a thirty-seventh aspect when referring back to the thirty-sixth aspect, the capacitive MEMS device may further comprise a third electrode structure comprising a third conductive layer, wherein the third conductive layer comprises a further multiple segmentation which provides an electrical isolation between at least a first portion, a second portion and a third portion of the third conductive layer, wherein the first portion is a center portion of the third conductive layer, the second portion is a boundary portion of the third conductive layer, and the third portion is an intermediate portion of the third conductive layer between the first and second portions of the third conductive layer, and wherein the second conductive layer comprises a first membrane element and the third conductive layer comprises a second membrane element, the method may further comprise: polarizing the first conductive layer with a reference potential V, and differentially reading-out the first portion of the first membrane element and the first portion of the second membrane element.

According to a thirty-eighth aspect when referring back to the thirty-sixth aspect, the capacitive MEMS device may further comprise a third electrode structure comprising a third conductive layer, wherein the third conductive layer comprises a further multiple segmentation which provides an electrical isolation between at least a first portion, a second portion and a third portion of the third conductive layer, wherein the first portion is a center portion of the third conductive layer, the second portion is a boundary portion of the third conductive layer, and the third portion is an intermediate portion of the third conductive layer between the first and second portions of the third conductive layer, and wherein the second conductive layer comprises a first membrane element and the third conductive layer comprises a second membrane element, the method may further comprise: polarizing the first portion of the first membrane element with a first reference potential V1, and polarizing the first portion of the second membrane element with a second reference potential V2, and differentially reading-out the first portion of the first membrane element and the first portion of the second membrane element.

According to a thirty-ninth aspect when referring back to the thirty-sixth aspect, the first portion of the first membrane element and the first portion of the second membrane element may not be electrically connected, and the first and second reference potentials V1, V2 may be different.

Although the present embodiments have been described in detail, it should be understood that various changes, substitutions and alterations can be made herein without departing from the spirit and scope of the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A capacitive MEMS device comprising:

a first electrode structure comprising a first conductive layer;

a second electrode structure comprising a second conductive layer, wherein the second conductive layer at least partially opposes the first conductive layer;

a plurality of gaps in the second conductive layer, each gap providing an electrical isolation between two neighboring portions of the second conductive layer; and a non-conductive connecting structure comprising an isolating material for mechanically connecting the neighboring portions of the second conductive layer so that a first portion of the first electrode structure and a first portion of the second electrode structure form an active capacitance $C_{ACTIVE}$, a second portion of the first electrode structure and a second portion of the second electrode structure form a parasitic capacitance $C_{PAR}$, and the gaps and the neighboring portions form a coupling capacitance $C_{mSEG}$, and so that the following is true for a transfer factor $f_{TF}$ of the capacitive MEMS device:

$$f_{TF} = \frac{C_{ACTIVE}}{C_{ACTIVE} + \left(\frac{C_{PAR} \cdot C_{mSEG}}{C_{PAR} + C_{mSEG}}\right)}.$$

2. The capacitive MEMS device according to claim 1, wherein the gaps are arranged in an equidistant configuration to each other in the second conductive layer.

3. The capacitive MEMS device according to claim 1, wherein the gaps in the second conductive layer are arranged in a segmentation area of the second conductive layer, and wherein the segmentation area is formed only in a circumferential, border region of the second conductive layer.

4. The capacitive MEMS device according to claim 3, wherein the second conductive layer has a thickness D1 in the segmentation area, and wherein the gaps have a width W between D1/2 and 2*D1.

5. The capacitive MEMS device according to claim 1, wherein each gap has a width of between 100 to 1000 nm.

6. The capacitive MEMS device according to claim 1, wherein the gaps are completely filled with the isolating material of the non-conductive connecting structure.

7. The capacitive MEMS device according to claim 1, wherein the non-conductive connecting structure has a thickness of between 100 to 1000 nm.

8. The capacitive MEMS device according to claim 1, wherein the gaps provide an electrical isolation between a first portion, a second portion and a third portion of the second conductive layer, and wherein the first portion is a center portion of the second conductive layer, the second portion is a boundary portion of the second conductive layer, and the third portion is an intermediate portion of the second conductive layer between the first and second portions of the second conductive layer.

9. The capacitive MEMS device according to claim 8, further comprising a spacer, wherein the spacer is located between the second portion of the second conductive layer and the first conductive layer.

10. The capacitive MEMS device according to claim 8, wherein the first portion of the second conductive layer forms a displaceable area of the second electrode structure.

11. The capacitive MEMS device according to claim 1, wherein the second electrode structure comprises a multiple segmentation, and wherein the multiple segmentation comprises a double segmentation with two gaps and with one intermediate portion of the second conductive layer between a first portion and a second portion of the second conductive layer.

12. The capacitive MEMS device according to claim 1, wherein the second electrode structure comprises a multiple segmentation, wherein the multiple segmentation comprises a triple segmentation with two neighboring intermediate portions, and wherein the triple segmentation has three gaps.

13. The capacitive MEMS device according to claim 12, wherein the triple segmentation provides an electrical isolation between a first portion, a second portion, a third portion and a fourth portion of the second conductive layer, and wherein the first portion is a center portion of the first conductive layer, the second portion is a boundary portion of the second conductive layer, and the third and fourth portions are neighboring intermediate portions of the second conductive layer between the first and second portion of the second conductive layer.

14. The capacitive MEMS device according to claim 1, wherein the second electrode structure comprises a multiple segmentation, wherein the multiple segmentation comprises a quad segmentation with three neighboring intermediate portions of the second conductive layer, and wherein the quad segmentation has four gaps.

15. The capacitive MEMS device according to claim 14, wherein the quad segmentation provides an electrical isolation between a first portion, a second portion, a third portion, a fourth portion and a fifth portion of the second conductive layer, and wherein the first portion is a center portion of the first conductive layer, the second portion is a boundary portion of the first conductive layer, and the third, fourth and fifth portions are neighboring intermediate portions of the second conductive layer between the first and second portions of the second conductive layer.

16. The capacitive MEMS device according to claim 1, wherein a boundary portion of the second electrode structure is supported by a support structure and retained in a spaced apart position from the first electrode structure.

17. The capacitive MEMS device according to claim 1, wherein the first conductive layer of the first electrode structure forms a membrane, and wherein the second conductive layer of the second electrode structure forms a counter electrode with respect to the membrane.

18. The capacitive MEMS device according to claim 1, wherein a deflection of the first conductive layer of the first electrode structure with respect to the second conductive layer of the second electrode structure results in a change of capacitance between the first and second electrode structure.

19. The capacitive MEMS device according to claim 1, wherein the first conductive layer comprises a further multiple segmentation which provides an electrical isolation between at least three portions of the first conductive layer.

20. The capacitive MEMS device according to claim 19, wherein the further multiple segmentation provides an electrical isolation between a first portion, a second portion and a third portion of the first conductive layer, and wherein the first portion is a center portion of the first conductive layer, the second portion is a boundary portion of the first conductive layer, and the third portion is an intermediate portion of the first conductive layer between the first and second portions of the first conductive layer.

21. The capacitive MEMS device according to claim 19, wherein a plurality of gaps in the first conductive layer is arranged in a first segmentation area of the first conductive layer, wherein the plurality of gaps in the second conductive layer is arranged in a second segmentation area of the second conductive layer, and wherein the first segmentation area and the second segmentation area are arranged, in a vertical projection, in an at least partially overlapping configuration.

22. The capacitive MEMS device according to claim 1, further comprising a third electrode structure comprising a third conductive layer.

23. The capacitive MEMS device according to claim 22, wherein the third conductive layer comprises a further multiple segmentation which provides an electrical isolation between at least a first portion, a second portion and a third portion of the third conductive layer, wherein the first portion is a center portion of the third conductive layer, the second portion is a boundary portion of the third conductive layer, and the third portion is an intermediate portion of the third conductive layer between the first and second portions of the third conductive layer, and wherein the second conductive layer comprises a first membrane element and the third conductive layer comprises a second membrane element.

24. The capacitive MEMS device according to claim 23, further comprising:

a reference potential source for polarizing the first conductive layer with a reference potential V, and a read out circuit for differentially reading-out the first portion of the first membrane element and the first portion of the second membrane element.

25. The capacitive MEMS device according to claim 23, further comprising:

a first reference potential source for polarizing the first portion of the first membrane element with a first reference potential V1;

a second reference potential source for polarizing the first portion of the second membrane element with a second reference potential V2; and a read out circuit for differentially reading-out the first portion of the first membrane element and the first portion of the second membrane element.

26. The capacitive MEMS device according to claim 25, wherein the first portion of the first membrane element and the first portion of the second membrane element are not electrically connected, and wherein the first and second reference potentials V1, V2 are different.

27. A MEMS microphone comprising a capacitive MEMS device according to claim 1, wherein a displacement of the first conductive layer of the first electrode structure with respect to the second conductive layer of the second electrode structure is effected by an incident sound pressure change.

28. The capacitive MEMS device according to claim 1, wherein m is larger than 2.

29. A method for forming a capacitive MEMS device, the method comprising:

providing, in a stacked configuration, a first conductive layer, a second conductive layer and a support layer arranged between the first and second conductive layer;

forming a plurality of gaps in the second conductive layer for providing an electrical isolation between at least three portions of the second conductive layer;

depositing a dielectric layer onto the second conductive layer and into the gaps of the second conductive layer;

structuring the dielectric layer so that a non-conductive structure remains, wherein the non-conductive structure bridges the gaps, and mechanically connects and isolates portions of the second conductive layer so that a first portion of the first conductive layer and a first portion of the second conductive layer form an active capacitance $C_{ACTIVE}$, a second portion of the first conductive layer and a second portion of the second conductive layer form a parasitic capacitance $C_{PAR}$, and the gaps and neighboring portions form a coupling capacitance $C_{mSEG}$, and so that the following is true for a transfer factor $f_{TF}$ of the capacitive MEMS device:

$$f_{TF} = \frac{C_{ACTIVE}}{C_{ACTIVE} + \left(\frac{C_{PAR} \cdot C_{mSEG}}{C_{PAR} + C_{mSEG}}\right)};$$

and partially removing a support material between the first and second conductive layer so that a support structure remains in a peripheral area of the first and second conductive layers.

30. The method according to claim 29, wherein depositing the dielectric layer comprises directly deposing the dielectric layer with a deposition thickness to close the gaps.

31. The method according to claim 29, wherein depositing the dielectric layer comprises conformally depositing the dielectric layer onto the second conductive layer and into the gaps in the second conductive layer.

32. The method according to claim 29, wherein depositing the dielectric layer comprises depositing the dielectric layer to a thickness of at least half of a width of the gaps.

33. A method for operating a capacitive MEMS device, wherein the capacitive MEMS device comprises a first electrode structure including a first conductive layer, a second electrode structure including a second conductive layer, a plurality of gaps in the second conductive layer, each gap providing an electrical isolation between two neighboring portions of the second conductive layer, and a non-conductive connecting structure comprising an isolating material for mechanically connecting the neighboring portions of the second conductive layer, and wherein the second conductive layer at least partially opposes the first conductive layer so that a first portion of the first electrode structure and a first portion of the second electrode structure form an active capacitance $C_{ACTIVE}$, a second portion of the first electrode structure and a second portion of the second electrode structure form a parasitic capacitance $C_{PAR}$ and the gaps and neighboring portions form a coupling capacitance $C_{mSEG}$, and so that the following is true for a transfer factor $f_{TF}$ of the capacitive MEMS device:

$$f_{TF} = \frac{C_{ACTIVE}}{C_{ACTIVE} + \left(\frac{C_{PAR} \cdot C_{mSEG}}{C_{PAR} + C_{mSEG}}\right)},$$

the method comprising:

reading out the second electrode structure, wherein the read out is single-ended or differential.

34. The method according to claim 33, wherein the capacitive MEMS device further comprises a third electrode structure including a third conductive layer, wherein the third conductive layer comprises a further multiple segmentation which provides an electrical isolation between at least a first portion, a second portion and a third portion of the third conductive layer, wherein the first portion is a center portion of the third conductive layer, the second portion is a boundary portion of the third conductive layer, and the third portion is an intermediate portion of the third conductive layer between the first and second portions of the third conductive layer, and wherein the second conductive layer comprises a first membrane element and the third conductive layer comprises a second membrane element, the method further comprising:

polarizing the first conductive layer with a reference potential V; and differentially reading-out the first portion of the first membrane element and the first portion of the second membrane element.

35. The method according to claim 33, wherein the capacitive MEMS device further comprises a third electrode structure comprising a third conductive layer, wherein the third conductive layer comprises a further multiple segmentation which provides an electrical isolation between at least a first portion, a second portion and a third portion of the third conductive layer, wherein the first portion is a center portion of the third conductive layer, the second portion is a boundary portion of the third conductive layer, and the third portion is an intermediate portion of the third conductive layer between the first and second portions of the third conductive layer, and wherein the second conductive layer comprises a first membrane element and the third conductive layer comprises a second membrane element, the method further comprising:

polarizing the first portion of the first membrane element with a first reference potential V1, and polarizing the first portion of the second membrane element with a second reference potential V2; and differentially reading-out the first portion of the first membrane element and the first portion of the second membrane element.

36. The method according to claim 35, wherein the first portion of the first membrane element and the first portion of the second membrane element are not electrically connected, and wherein the first and second reference potentials V1, V2 are different.

* * * * *